US008336750B2

(12) United States Patent
Maemori

(10) Patent No.: US 8,336,750 B2
(45) Date of Patent: Dec. 25, 2012

(54) STAPLER

(75) Inventor: Jun Maemori, Gunma (JP)

(73) Assignee: Max Co., Ltd, Tokyo (JP)

( * ) Notice: Subject to any disclaimer, the term of this patent is extended or adjusted under 35 U.S.C. 154(b) by 146 days.

(21) Appl. No.: 12/676,587

(22) PCT Filed: Sep. 5, 2008

(86) PCT No.: PCT/JP2008/066122

§ 371 (c)(1),
(2), (4) Date: May 19, 2010

(87) PCT Pub. No.: WO2009/031666

PCT Pub. Date: Mar. 12, 2009

(65) Prior Publication Data

US 2010/0288815 A1 Nov. 18, 2010

(30) Foreign Application Priority Data

Sep. 5, 2007 (JP) ..... 2007-230688
Sep. 5, 2007 (JP) ..... 2007-230689
Sep. 5, 2007 (JP) ..... 2007-230690

(51) Int. Cl.

| | |
|---|---|
| ***B25C 5/02*** | (2006.01) |
| ***B25C 5/06*** | (2006.01) |
| ***B25C 1/00*** | (2006.01) |
| ***B27F 7/00*** | (2006.01) |

(52) U.S. Cl. ..... 227/127; 227/132

(58) Field of Classification Search ..... 227/107–156; 606/219; 411/920

See application file for complete search history.

(56) References Cited

U.S. PATENT DOCUMENTS

| | | | | |
|---|---|---|---|---|
| 3,625,408 | A * | 12/1971 | Amakawa et al. | 227/131 |
| 3,958,738 | A * | 5/1976 | Tremblay | 227/109 |
| 4,523,707 | A * | 6/1985 | Blake et al. | 227/19 |
| 4,574,992 | A * | 3/1986 | Holman | 227/83 |
| 4,640,451 | A * | 2/1987 | Steiner et al. | 227/76 |
| 4,669,647 | A * | 6/1987 | Storace | 227/19 |
| 5,114,065 | A * | 5/1992 | Storace | 227/175.1 |

(Continued)

FOREIGN PATENT DOCUMENTS

EP 1541289 A1 * 6/2005

(Continued)

OTHER PUBLICATIONS

Japanese Patent Office, International Search Report for PCT/JP2008/066122, Sep. 22, 2008.

*Primary Examiner* — Robert Long

(74) *Attorney, Agent, or Firm* — Chernoff Vilhauer McClung Stenzel LLP

(57) ABSTRACT

A stapler 100 is provided with a driver 5 provided at a forward end of the driver arm 4, as shown in FIG. 20A, driving a staple 30 out according to any predetermined clinching force, the driver 5 having projections 5*b*, 5*b* which contact portions of the staple 30 over the legs of the staple pushed against the front inner wall of the magazine 3 by a staple-pushing member 40. Accordingly, the clinching force is transferred to the legs through the projections 5*b*, 5*b* of the driver 5 so that the clinching force can be concentrated onto the legs. Furthermore, a staple-pushing member 40 pushes the staple 30, so that it is possible to prevent buckling from occurring in the legs.

7 Claims, 30 Drawing Sheets

U.S. PATENT DOCUMENTS

| | | | | |
|---|---|---|---|---|
| 5,560,532 | A * | 10/1996 | DeFonzo et al. | 227/176.1 |
| 5,772,379 | A * | 6/1998 | Evensen | 411/442 |
| 6,244,491 | B1 * | 6/2001 | Kandasamy et al. | 227/134 |
| 7,510,106 | B2 * | 3/2009 | Manabe | 227/107 |
| 7,731,071 | B2 * | 6/2010 | Melgaard et al. | 227/139 |
| 7,757,923 | B2 * | 7/2010 | Huang et al. | 227/132 |
| 7,823,759 | B2 * | 11/2010 | Jiang | 227/132 |
| 2002/0117534 | A1 * | 8/2002 | Green et al. | 227/176.1 |
| 2007/0057011 | A1 * | 3/2007 | Kandasamy et al. | 227/134 |
| 2007/0057012 | A1 * | 3/2007 | Kandasamy et al. | 227/134 |
| 2008/0308598 | A1 * | 12/2008 | Chang | 227/128 |
| 2009/0045238 | A1 * | 2/2009 | Melgaard et al. | 227/120 |
| 2009/0065548 | A1 * | 3/2009 | Chang | 227/120 |
| 2009/0314819 | A1 * | 12/2009 | Co | 227/120 |
| 2010/0314432 | A1 * | 12/2010 | Wang | 227/120 |
| 2011/0049213 | A1 * | 3/2011 | Schneider et al. | 227/120 |

FOREIGN PATENT DOCUMENTS

| | | | |
|---|---|---|---|
| JP | 118182/1982 | | 7/1982 |
| JP | 2-262972 | A | 10/1990 |
| JP | 117577/1991 | | 12/1991 |
| JP | 11-42569 | A | 2/1999 |
| JP | 2004-50350 | A | 2/2004 |
| JP | 2005-144648 | A | 6/2005 |
| JP | 2005144648 | A * | 6/2005 |

* cited by examiner

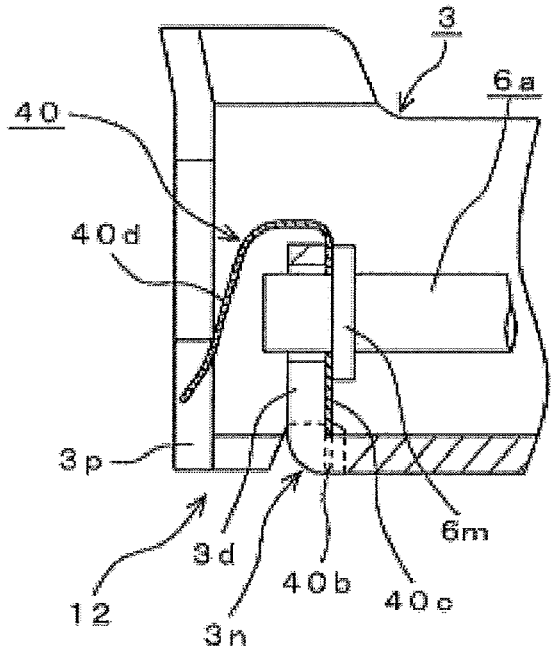
FIG. 10B
FIG. 11A
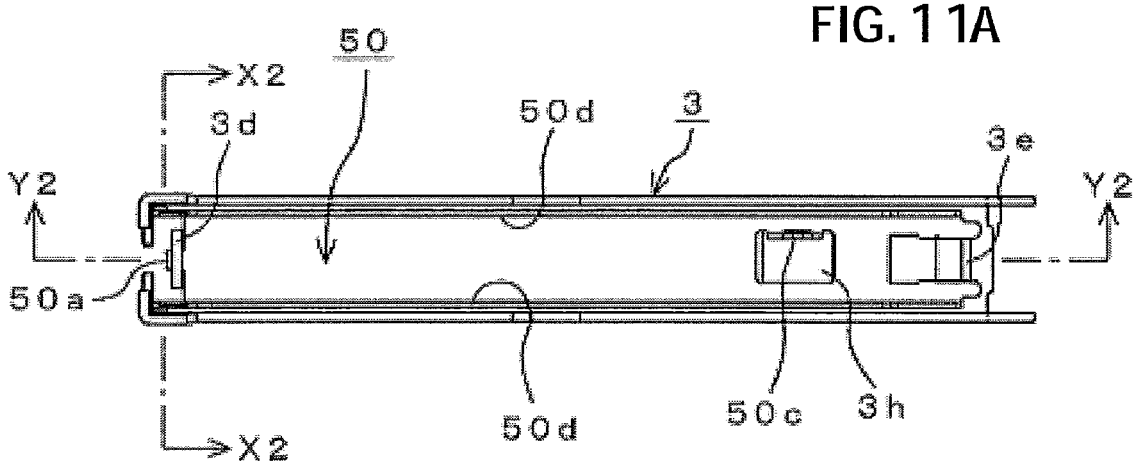

STAPLER

This is a national stage application filed under 35 USC 371 based on International Application No. PCT/JP2008/066122 filed Sep. 5, 2008, and claims priority under 35 USC 119 of Japanese Patent Application No. 2007-230688 filed Sep. 5, 2007, Japanese Patent Application No. 2007-230689 filed Sep. 5, 2007, and Japanese Patent Application No. 2007-230690 filed Sep. 5, 2007.

TECHNICAL FIELD

The invention relates to a stapler. More particularly, it relates to a stapler that passes a pair of legs of a staple, which is constituted of a crown portion and the legs extending from both ends of the crown portion, through a stack of paper based on any predetermined clinching force and clinches the legs of staple to staple the stack of paper.

BACKGROUND ART

Among cases where stapling a stack of paper, a stapler has often driven the staple into the stack of paper to staple the stack of paper until now. This stapler contains a clincher arm, a magazine, a pusher, a driver arm, a driver, a handle, and the like. The pusher pushes a strip of staples loaded in the magazine to bias it onto a staple-pushing-out slot of the magazine.

When any clinching force is applied to the clincher arm, the magazine, and the driver arm, which share a main shaft with their shaft-receiving portions, through the handle, the driver provided at a forward end of the driver arm drives a top staple of the strip of staples loaded in the magazine out of the staple-pushing-out slot. For example, a forward end of the driver is formed flat and pushes the whole crown portion of the staple to drive it out. Since the driven staple comes into contact with a clincher provided with a forward end of the clincher arm, the legs thereof are clinched round or flat.

When this operation is performed with the stack of paper being clipped by the magazine and the clincher, the staple, the legs of which are clinched round or flat, can staple this stack of paper.

In relation to such a conventional example, Japanese Patent Application Publication No. H09-085644 has disclosed a stapler on page 3 and FIG. 2 thereof in which a forward end of pushing-out portion for pushing the staple out is formed so as to be concave. According to this stapler, both ends of the concave forward end of the pushing-out portion contact portions of the staple over the legs thereof when pushing the staple out. This enables any force applied to the staple by the pushing-out portion to be concentrated on the legs of the staple so that it can be more increased than that of a past case.

DISCLOSURE OF THE INVENTION

Problems to be Solved by the Invention

By the way, according to the stapler concerning the conventional example, by applying any predetermined clinching force, the flat-formed forward end of the driver pushes the whole crown portion of the staple to drive the staple out. This causes any pushing force for pushing the whole crown portion thereof to spread over the crown portion, so that if a stack of paper in which there is a large number of sheets of paper (around its maximum stackable sheets) is particularly stapled, a problem occurs such that buckling is easily generated by failing to concentrate the pushing force on the legs of the staple.

According to the staple disclosed in Japanese Patent Application Publication No. H09-085644, which has coped with this problem, the buckling is prevented by concentrating the pushing force to the legs by the push-out portion, the forward end of which is formed so as to be concave. It is, however, difficult to prevent the buckling merely by concentrating the pushing force to the legs. This is because a large amount of pushing force is applied to the legs if postures of the legs are inclined even slightly against a sheet of paper.

Means for Solving the Problems

This invention solves such problems relating to the conventional examples and has an object to provide a stapler that is capable of concentrating the clinching force onto the legs of staple and preventing the buckling of the staple from occurring.

In order to solve the above-mentioned problems, a stapler according to the invention passes a pair of legs of a staple, which is constituted of a crown portion and the legs extending from both ends of the crown portion, through a stack of paper based on any predetermined clinching force and clinches the legs thereof to staple the stack of paper, and is characterized in that the stapler comprises a magazine that loads a staple therein, the magazine containing a staple-pushing-out slit at an end thereof, a driver arm that contains a driver which comes into contact with the crown portion of the staple positioned on the staple-pushing-out slit at an end thereof and drives the staple based on the predetermined clinching force, and a staple-pushing member that is mounted near the staple-pushing-out slit and pushes the crown portion of the staple driven out by the driver arm against a front inner wall of the magazine wherein the driver of the driver arm includes a projection that comes into contact with a portion of the staple over the legs thereof, the staple being pushed against the front inner wall of the magazine by the staple-pushing member.

In the stapler according to the present invention, the projection of the driver of the driver arm drives the staple with the projection contacting the portion of the staple over the legs thereof, the staple being pushed against the front inner wall of the magazine by the staple-pushing member. This enables clinching force to be transferred to the legs through the projection of the driver, thereby concentrating the clinching force on the legs.

Furthermore, since the staple is pushed by the staple-pushing member, the buckling may be prevented from occurring in the legs. Alternatively, if the driver is provided with projections at both ends thereof, the driver drives the staple with the crown portion thereof being curved by the projections, so that reaction by the stack of paper to the legs can be set off. Accordingly, as the staple may receive the reaction borne to it suitably, it is possible to provide the stapler that has high resistance to the buckling.

BRIEF DESCRIPTION OF DRAWINGS

[FIG. 10B] is an enlarged view of the magazine 3 for showing a part of the magazine 3 enclosed by broken lines shown in FIG. 10A;

[FIG. 11A] is a top view of the magazine 3 for showing an attachment of a staple guide 50 thereto;

[FIG. 12B] is an enlarged view of the magazine 3 for showing a part of the magazine enclosed by broken lines shown in FIG. 12A;

BEST MODE FOR CARRYING OUT THE INVENTION

The following will describe embodiments of a stapler according to the invention and a staple therefor with reference to the attached drawings.

Figure 1:
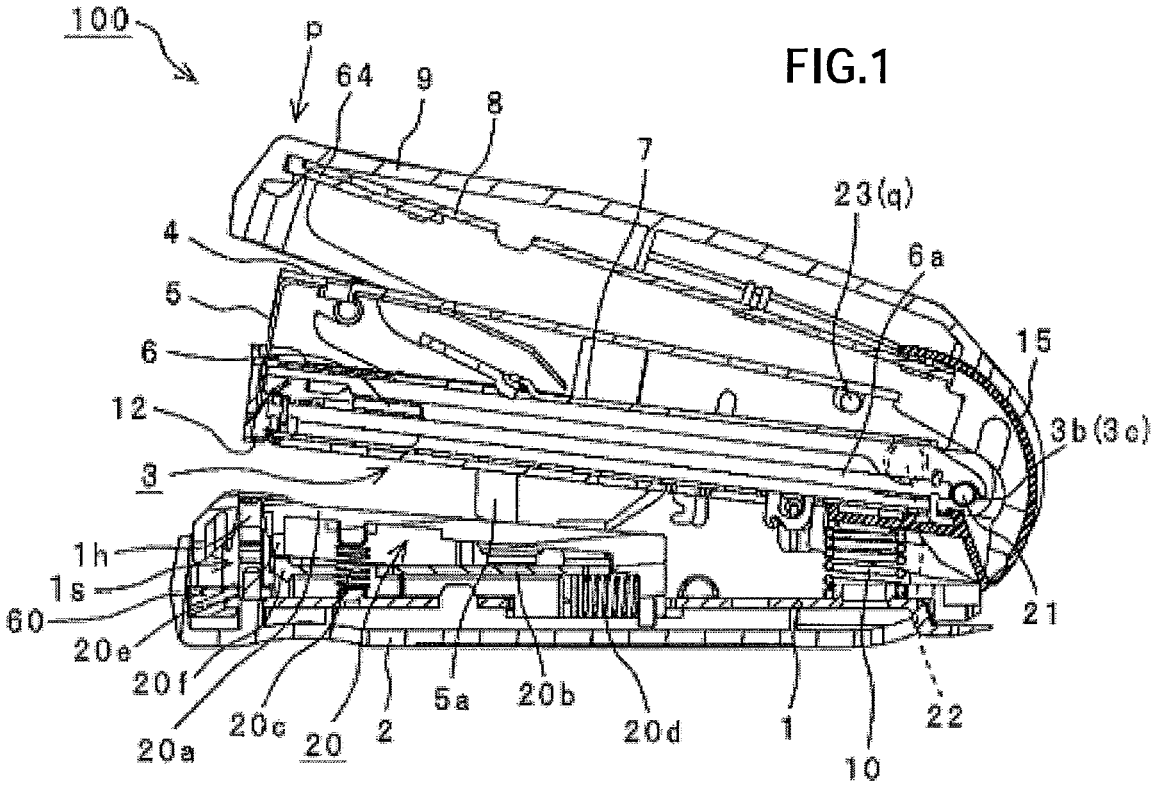
[FIG. 1] is a sectional view of an embodiment of a stapler 100 according to the invention for showing a configuration example thereof.
Figure 2:
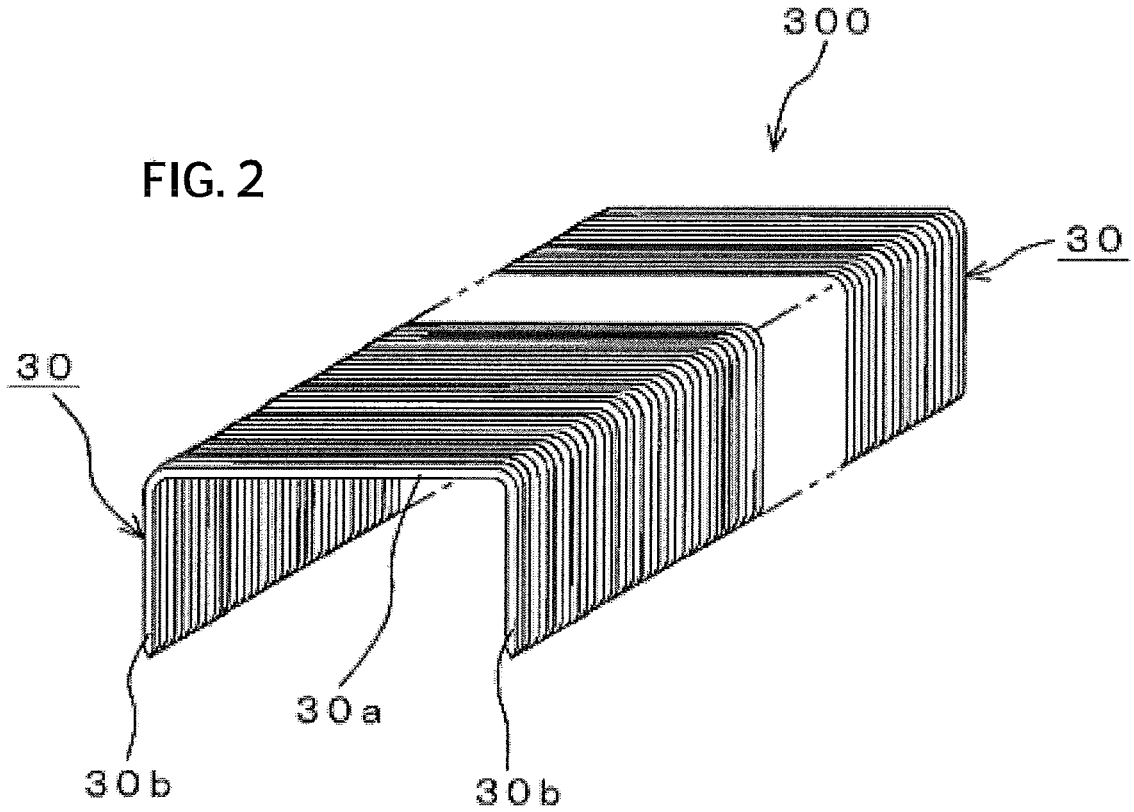
[FIG. 2] is a perspective view of a strip of staples 300 for showing a configuration example thereof.

A configuration example of an embodiment of the stapler 100 according to the invention will be described with reference to FIG. 1. The stapler 100 shown in FIG. 1 is a small-sized portable stapler. It is supposed that for this stapler 100, a strip of staples 30, as shown in FIG. 2, each staple having a size larger than that of a staple of No. 10 based on JIS S6036 and smaller than that of a staple of No. 3 based on JIS S6036, namely, an intermediate sized staple 30 between the staple of No. 10 and the staple of No. 3 is suitably used.

The stapler 100 has a function to clinch the staple 30 based on any predetermined clinching force. This stapler 100 has a clincher arm 1. The clincher arm 1 is made of a metal plate and is formed by bending the metal plate so as to have a bottom and both sides. The clincher arm 1 constitutes a base portion of a main body of the stapler 100. A clincher portion is mounted on a forward end of the clincher arm 1. This clincher portion is has a clincher 1*h*, on an upper end surface of which grooves are formed, and a spring, not shown, for biasing the clincher 1*h* upwards. The grooves formed on the upper end surface of the clincher 1*h* function as bending the legs 30*b* (see FIG. 2) of the staple 30 round or flat. It is to be noted that the clincher 1*h* having a configuration as shown in the embodiment is indicated as a preferable case where the legs 30*b*, 30*b* of the staple 30 are bent flat.

Further, this clincher 1*h* is formed so as to have such a linear bending structure that the grooves are formed linearly on the same line and the legs 30*b* are fitted along the grooves and bent in the same line (hereinafter, referred to as "in-line clincher system") or such a tips-not-facing bending structure that the grooves are formed on two lines and the legs 30*b* are bent by the grooves not so as to face the tips of the legs 30*b* to each other (hereinafter, referred to as "by-pass clincher system"). It is to be noted that in this embodiment, the in-line clincher system is applicable to the clincher 1*h*.

The clincher 1*h* biased upwards is positioned so as to stay within an opening in a clincher guide portion 20. In this embodiment, an upper end surface of the clincher 1*h* is set so as to become stationary at a position (upper dead point) that is approximately equal to the opening of the clincher guide portion 20.

This clincher guide portion 20 is mounted on the clincher arm 1 and once maintains a space between the magazine 3 and the clincher 1*h* when the staple 30 is driven out of a staple-pushing-out slit 12 of the magazine 3. The clincher guide portion 20 is then pushed down by the magazine 3 based on an operation of an operation lever 5*a* attached to a driver arm 4.

This clincher guide portion 20 is constituted of a clincher guide 20*a*, a sliding member 20*b*, and coil springs 20*c*, 20*d*. The clincher guide 20*a* has an engaging claw, not shown, at a rear end of the clincher guide 20*a*, and the engaging claw rotatably engages an edge of an opening portion, not shown, formed in the clincher arm 1. This clincher guide 20*a* is biased upwards by the coil spring 20*c*. On a forward end portion of the clincher guide 20*a*, contacting column 20*e* extending from a main body of the clincher guide 20*a* downwards in a nearly vertical direction is provided. This contacting column 20*e* is supported by a contact with a supporting portion 20*f* of the sliding member 20*b*, which is slidably attached. This enables the clincher guide 20*a* to be locked by the sliding member 20*b*. This sliding member 20*b* is biased forward by the coil spring 20*d*. Thus, the clincher guide portion 20 is configured.

A cover for clincher arm (hereinafter, referred to as "clincher arm cover 2"), which is made of synthetic resin and to which any design is applied, covers a rear surface side of the clincher arm 1. The magazine 3 is rotatably mounted on this clincher arm 1. The magazine 3 has a main frame 3*a* (see FIG. 7) having a predetermined shape. The magazine 3 contains the staple-pushing-out slit 12 formed on a forward end portion of its main frame 3*a* and holes for supporting the main shaft (hereinafter, referred to as "holes 3*b*, 3*c*") formed on the other portion thereof as well as loads a strip of staples 300.

The main shaft 21 is inserted into the holes 3*b*, 3*c* of the clincher arm 1 at a rear side of the magazine 3. The magazine 3 may be designed so as to load merely one or two strips of the staples 300, one strip being constituted of 50 staples (see FIG. 2).

In the magazine 3, the pusher 6 is put on a spring guide 6*a* so as to be slidably guided, and pushes the strip of staples 300 loaded in the magazine 3 toward the staple-pushing-out slit 12 formed on a forward end of the magazine 3.

A coil spring 10 stands between a rear side of the magazine 3 and a rear side of the clincher arm 1. This coil spring 10 operates so as to keep a predetermined space between the clincher arm 1 and the magazine 3 in order to allow the stack of paper to intervene in the space between the clincher arm 1 and the magazine 3.

To the above-mentioned main shaft 21, the driver arm 4 is rotatably attached. This driver arm 4 has a main frame. This main frame is formed by bending a metal plate so as to have a top surface and both side surfaces. The driver arm 4 has the driver 5 at an end (forward end) thereof and holes for receiving the main shaft 21 (a first driving-shaft-supporting portion) at the other end (rear end) thereof.

The driver 5 has an almost L-shape having elasticity. A main body of the driver 5 is fixed closely to the top surface of the main frame of the driver arm and a forward portion of the driver 5 is fixed so as to be nearly perpendicular to the top surface of the main frame of the driver arm. Further, a rear portion of the driver 5 is formed so as to be curved away from the top surface of the main frame of the driver arm 4 so that a curved elastic portion 5*c* (see FIG. 16A) contacts a staple cover 7 mounted on the magazine 3. This enables a space between the driver arm 4 and the magazine 3 to be kept constant under standby state of the stapler 100. It is to be noted that the staple cover 7 shares the main shaft 21 by its rear end and covers the strip of staples 300 loaded in the magazine 3.

When driving the driver arm 4 in a direction (counterclockwise) for clinching the staple 30, the rear portion of the elastic driver 5 approaches to the driver arm 4 and the driver 5 advances within the magazine 3. This driver 5 comes into contact with an upper portion of a top staple 30 of the strip of staples 300 pushed by the pusher 6 and pushes the upper portion of the top staple 30 down by pushing-down force applied to the driver arm 4 to drive the top staple 30 to a stack of paper.

The staple cover 7 is mounted on the magazine 3 inside the main frame of the driver arm 4 and pushes down the strip of staples 300 loaded in the magazine 3. The staple cover 7 is rotatably attached to the main shaft 21. In this embodiment, the staple cover 7 has a U-shaped end, which is spread out over the main shaft 21, and is rotatably supported by the main shaft 21.

A handle 8 is provided over the driver arm 4 and is manipulated so as to apply any clinching force to the driver 5 of the driver arm 4. The handle 8 has a main frame 8*a* (see FIG. 25) formed by bending a metal plate so as to have a top surface and both side surfaces.

A handle cover 9 is provided on the handle 8 to cover a surface of the main frame 8*a* of the handle 8. The handle cover 9 is constituted of a molded frame which is made of synthetic resin and to which any design is applied, similar to a case of the clincher arm cover 2.

The handle 8 and the handle cover 9 rotatably pivot around a second driving-shaft-supporting portion (hereinafter, referred to as "connection axis 22"), which is positioned above the main shaft 21, at their rear portions. For example, the connecting axis 22 is constituted of projected axes 22*a*, 22*a* (see FIG. 23B) which are provided as bosses on side surfaces of the sheet metal of the clincher arm 1 by a burring process or the like, and axis-receiving portions 22*b*, 22*b* (see FIG. 25), each of which is recessed as U-shaped on the side surface of the handle 8.

Furthermore, there is a point of application "q" for pushing the driver arm 4 down on the way from the connection axis 22 of the handle 8 and the handle cover 9 to the forward end of the magazine 3 (to a direction of a staple-pushing-out slit). An axis for the point of application (hereinafter, referred to as "application axis 23"), which may be freely engaged with the handle 8 and the driver arm 4, is provided at the point of application "q".

Thus, when the connection axis 22 is positioned at an upper position than that of the main shaft 21 that is shared by the magazine 3 and the driver arm 4, the driver arm 4 is pushed down at the point of application "q" with the connection axis 22 acting as a fulcrum if any force is applied to the forward end of each of the handle 8 and the handle cover 9, which is set as a point "p" where the force is to be applied to the stapler. Thus, the stapler 100 can staple the stack of paper by a staple 30 with less pushing-down force that is applied to the point "p" of the handle cover 9 (using a mechanism for multiplication of force achieved by a lever-fulcrum relationship).

A back cover 15 is provided on a rear end portion of the stapler 100, which is constituted of the main shaft 21 of magazine 3, the driver arm 4, and the staple cover 7 and the connection axis 22 of the handle 8 and the handle cover 9, and the like. This back cover 15 can prevent any foreign matter from entering into an opening formed by any rear parts of the stapler 100 such as the clincher arm cover 2, the handle cover 9 and the like, and can realize a stapler 100 having a good appearance in an external design.

The following will describe an operation of the stapler 100. When the handle 8 is pushed down through the upper side of the handle cover 9, the handle 8 rotates around the connection axis 22 to push the application axis 23 down. When the application axis 23 is pushed down, the driver arm 4 and the magazine 3 rotate around the main shaft 21 and a forward end of the magazine 3 contacts a forward end side of the clincher guide 20*a*. When the handle 8 is further pushed down in this state, the handle 8 and the driver arm 4 rotate with positions of the magazine 3 and the clincher guide 20*a* are fixed and then, the driver 5 provided on a forward end of the driver arm 4 drives the top staple 30 of the strip of staples 300 loaded in the magazine 3 to push it out of the staple-pushing-out slit 12 from inside of the magazine 3 to outside. Pushed-out staple 30 descends with the legs 30*b* being kept on their straight states and pushes the clincher 1*h* down to a bottom dead center thereof against the biasing force by a spring, not shown, for biasing the clincher 1*h* upwards.

Then, when the handle 8 is further pushed down, an operation lever 5*a* proved on this driver 5 rotates counterclockwise, and the sliding member 20*b* retreats and is moved rearwards by the forward end of the operation lever 5*a*. This rearward movement of the sliding member 20*b* causes to be made free (to its clutch-off state) the contacting column 20*e* of the clincher guide 20*a* that has been supported by the supporting portion 20*f* of the sliding member 20*b*. The clincher guide 20*a* is then pushed down and swung through the magazine 3 together with rotations of the handle 8, the driver 5, and the magazine 3. In this moment, by the rotation of the driver 5 and the clincher 1*h* positioned at the bottom dead center, legs 30*b* of the staple 30 contacted with the driver 5 are bent flat. Thus, clinching operation by the staple 30 is performed.

The following will describe configurations of the staple 30 and the strip of staples 300. The strip of staples 300 shown in FIG. 2 is constituted of 50 staples that are welded together in series. The strip of staples 300 is loaded in the magazine 3.

The staple 30 is constituted of the crown portion 30*a* and a pair of legs 30*b* extending downwards from both ends of the crown portion 30*a*.

Figure 3A:
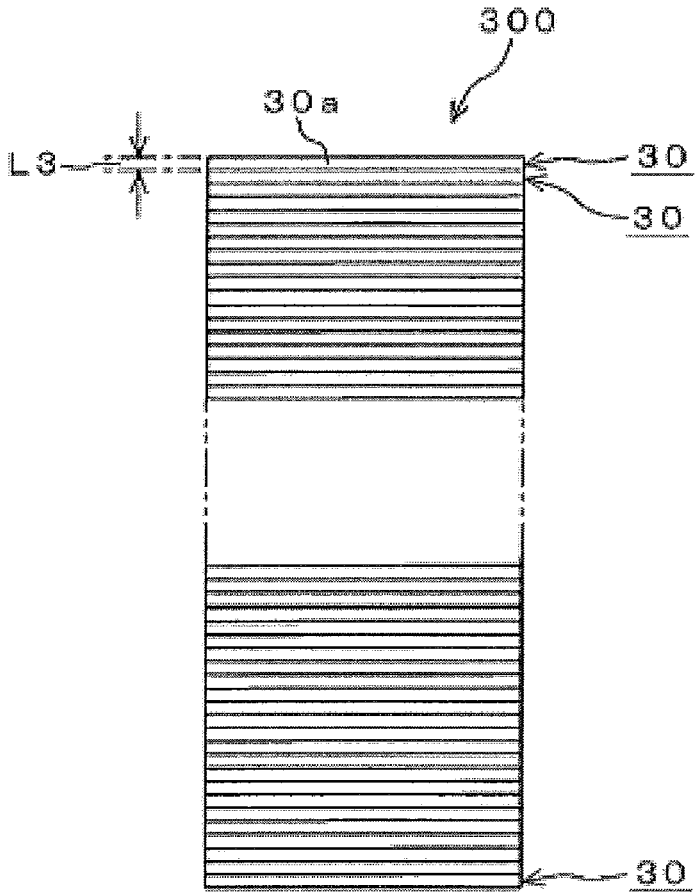
[FIG. 3A] is a top view of the strip of staples 300 for showing a configuration example thereof.
Figure 3B:
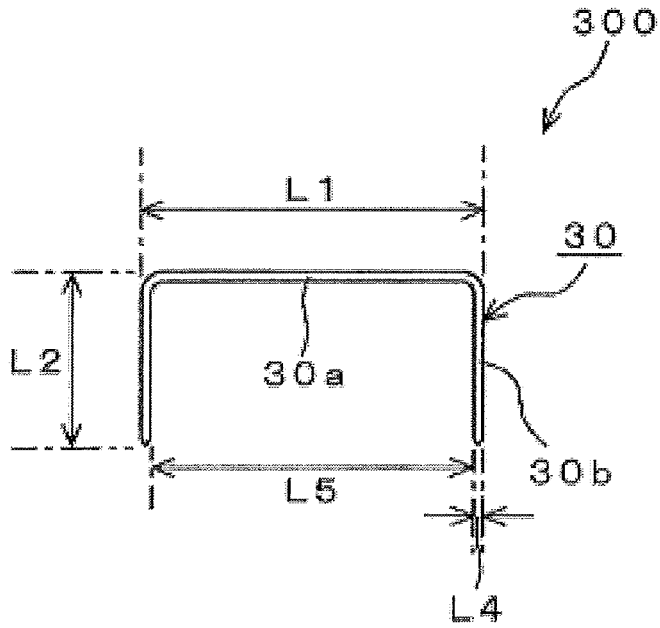
[FIG. 3B] is a front view of the strip of staples 300 for showing a configuration example thereof.

FIG. 3A shows a top surface of the strip of staples 300 shown in FIG. 2 and FIG. 3B shows a front surface of the strip of staples 300 shown in FIG. 2. If it is supposed that length to which an inner width L5 between a pair of the legs 30*b* shown in FIG. 3B and thickness L4 of each of the legs 30*b* is added is set as whole length L1 of the crown portion 30*a* of the staple 30, the whole length L1 of the crown portion 30*a* is formed so as to be longer than 9.48 mm and shorter than 12.45 mm. Further, it is formed so that the sum of a pair of the lengths L2 of the pair of legs 30*b* of the staple 30 is not longer than the whole length L1 of the crown portion 30*a*. Additionally, thickness L3 of the crown portion 30*a* along a direction of movement thereof is formed so as to be thicker than 0.47 mm and thinner than 0.53 mm. The thickness L4 of each of the legs 30*b* is formed so as to be thicker than 0.30 mm and thinner than 0.54 mm.

Figure 4A:
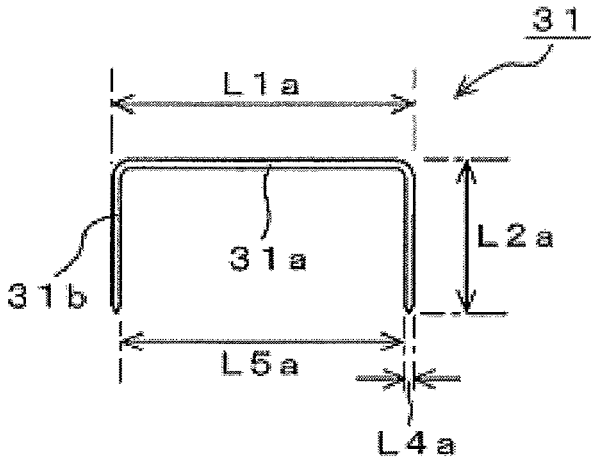
[FIG. 4A] is a front view of a staple 31 concerning No. 10 based on Japanese Industrial Standard (hereinafter, referred to as "JIS") S6036 concerning a conventional example.
Figure 4B:
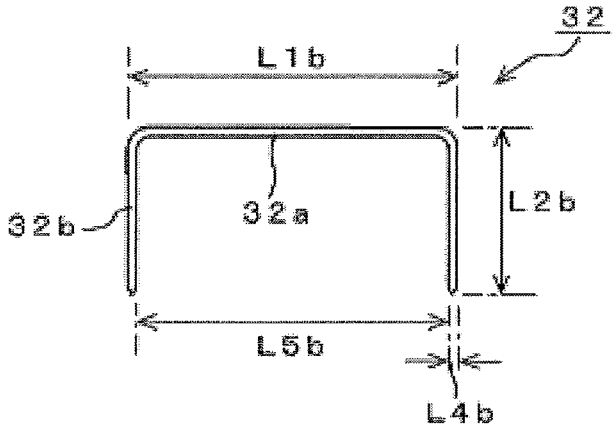
[FIG. 4B] is a front view of a staple 32 concerning No. 3 based on JIS S6036 concerning a conventional example.
Figure 4C:
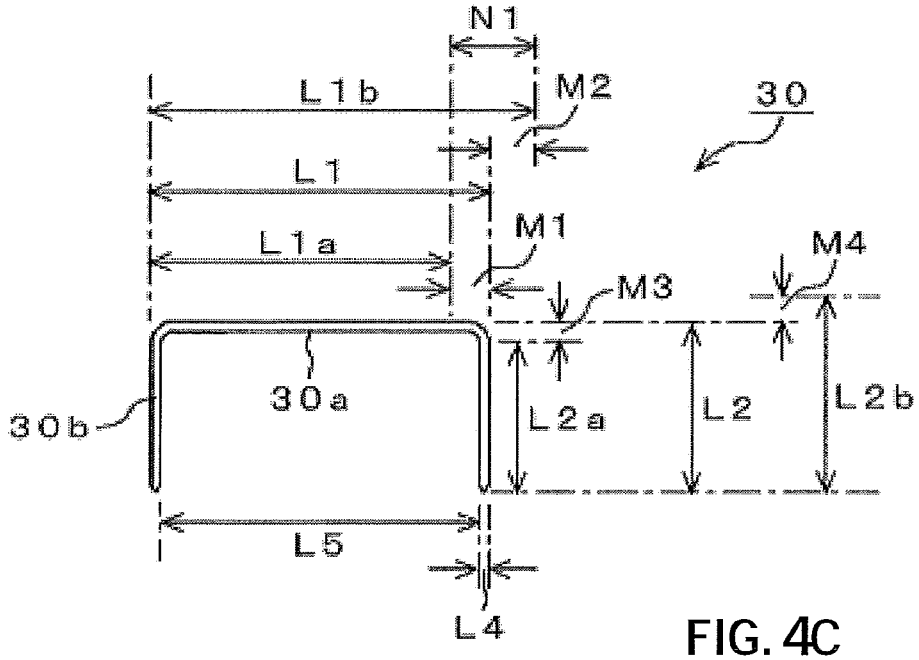
[FIG. 4C] is a front view of a staple 30 according to the invention for showing a configuration example thereof.

The following will describe comparison examples of the staples 31, 32 and the staple 30 used in this stapler 100 according to the invention with reference to FIGS. 4A through 4C. The staple 31 of No. 10 based on JIS S6036 as shown in FIG. 4A is used with supposing a case where a stack of paper of about 20 sheets of paper is stapled and whole length L1*a* of the crown portion 31*a* is regulated so as to be not longer than 9.48 mm and an inner width L5*a* between a pair of the legs 31*b* is regulated so as to be not shorter than 8.40 mm. Further, length L2*a* of each of the legs 31*b* of the staple 31 is regulated so as to be 4.8 plus or minus 0.2 mm, thickness L4*a* of each of the legs 31*b* is regulated so as to be not thinner than 0.30 mm, and thickness of the crown portion 31*a* along a direction of movement thereof is regulated so as to be 0.50 mm plus or minus 0.03 mm.

On the other hand, the staple 32 of No. 3 based on JIS S6036 as shown in FIG. 4B is used with supposing a case where a stack of paper of about 30 sheets of paper is stapled and length Lib of the crown portion 32*a* is regulated so as to be not longer than 12.97 mm and an inner width L5*b*, 5*b* between a pair of the legs 32*b* is regulated so as to be not shorter than 11.55 mm. Further, lengths L2*b* of each of the legs 32*b* is regulated so as to be 6.0 plus or minus 0.2 mm, thickness L4*b* of each of the legs 32*b* is regulated so as to be not thinner than 0.45 mm, and thickness of the crown portion 32*a* along a direction of movement thereof is regulated so as to be 0.70 mm plus or minus 0.03 mm.

The staple 30 shown in FIG. 4C is formed so as to have an intermediate size between the above-mentioned staple 31 of No. 10 and the above-mentioned staple 32 of No. 3 . In this embodiment, the crown portion 30*a* of the staple 30 is formed so as to be longer than the whole length L1*a* of the crown portion 31*a* of the staple 31 of No. 10 by difference M1 and shorter than the whole length Lib of the crown portion 32*a* of the staple 32 of No. 3 by difference M2.

The whole length L1 of the crown portion 30*a* of this staple 30 is longer than the above-mentioned whole length L1*a* and shorter than the above-mentioned whole length Lib, namely, is set to one within a range N1 (0 mm<N1<2.97 mm) satisfying a relationship of L1*a*<L1<L1*b*. This maximum, 2.97 mm, is obtained by calculating a formula, Lib (12.45 mm)−L1*a* (9.48 mm). Thus, the whole length L1 of the crown portion 30*a* of the staple 30 is set.

Length L2 of each of the legs 30*b* of the staple 30 is formed so that the sum of a pair of the lengths L2 of a pair of legs 30*b* is not longer than the whole length L1 of the crown portion 30*a*. In this embodiment, the length L2 of the leg 30*b* of the staple 30 is formed so as to be longer than the length L2*a* of the leg 31*b* of the staple 31 by difference M3 and shorter than the length L2*b* of the leg 32*b* of the staple 32 by difference M4.

Accordingly, as the crown portion 30*a* and the legs 30*b* of the staple 30 are formed so as to have an intermediate size between those of the staples of Nos. 3 and 10, it is possible to staple a stack of paper from a thin stack of paper to a stack of paper (a stack of paper being constituted of more than 20 sheets of paper to be clinched), which can be not stapled by the staple 31 of No. 10 , by means of one species of staple.

Furthermore, as the sum of the lengths L2 of a pair of legs 30*b*, 30*b* of the staple 30 is set to be not longer than the whole length L1 of the crown portion 30*a*, it is capable of preventing forward ends of the legs 30*b* from inserting the stack of paper again even when the legs 30*b* of staple 30 staple a stack of paper, particularly, a very thinner stack of paper. Further, the legs 30*b* of the staple 30 clinched on the rear surface of the stack of paper are not contacted with each other.

Further, in this embodiment, thickness L4 of each of the legs 30*b* of the staple 30, namely, thickness of a wire rod of the staple 30 is set so as to have thickness almost equal to thickness L4*a* of each of the legs 30*b* of the staple 31 of No. 10 . Additionally, in this embodiment, the thickness L3 of the crown portion 30*a* of the staple 30 (see FIG. 3A) is set so as to have thickness almost equal to the thickness of the staple 31 of No. 10 along a direction of movement thereof.

Figure 5A:
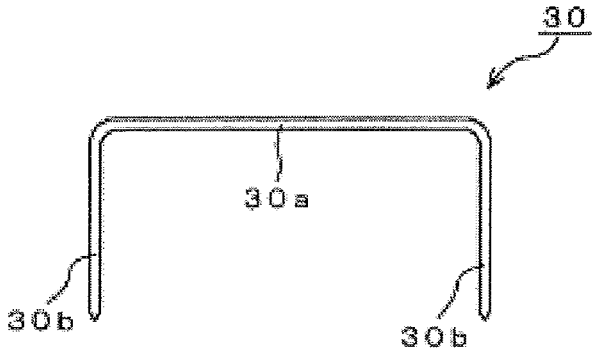
[FIG. 5A] is a front view of the staple 30 for showing a basic state thereof.
Figure 5B:
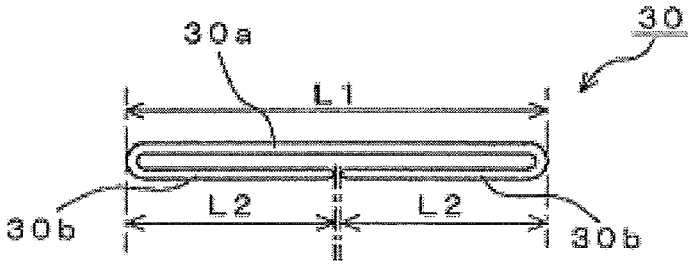
[FIG. 5B] is a front view of the staple 30 for showing a bent state thereof.

The following will describe an example of the staple 30 with reference to FIGS. 5A and 5B. FIG. 5A shows a basic state of the staple 30. FIG. 5B shows a bent state of the staple 30 in which a base portion of each of the legs 30*b* is bent flat inwards at about 90 degrees from the basic state shown in FIG. 5A. In this bent state, the sum of the pair of legs 30*b* (L2+L2) is not longer than the whole length L1 of the crown portion 30*a*.

Accordingly, forward ends of the legs 30 of staple 30 cannot contact with each other in the bent state, thereby enabling a thin stack of paper constituted of about two sheets of paper to be stapled. Further, the length L2 of each of the legs 30*b* is preferably set so as to have maximum length such that forward ends of the legs 30*b* are not contacted to each other and each of these legs 30*b* has length longer than that of each of the legs 31*b* of the staple 31 of No. 10 by the difference M3, so that it is capable of stapling a thick stack of paper which can be not stapled by the staple 31 of No. 10.

Figure 6A:
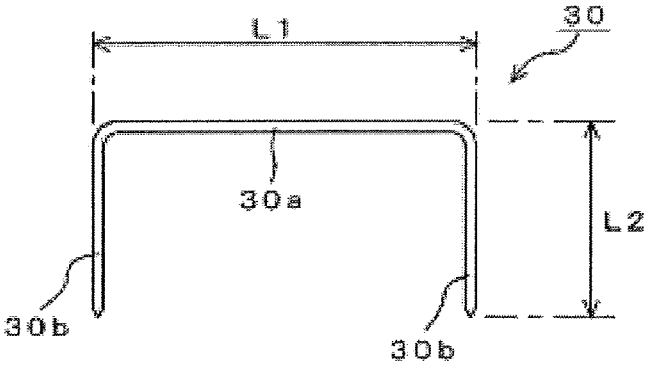
[FIG. 6A] is a front view of a preferable staple 30 for showing a basic state thereof.

It is to be noted that the whole length L1 of the crown portion 30*a* of the staple 30 may be preferably not shorter than 11.35 mm and not longer than 11.49 mm and the length L2 of each of the pair of legs 30*b* may be not shorter than 5.7 mm and not longer than 6.0 mm, as shown in FIG. 6A.

Figure 6B:
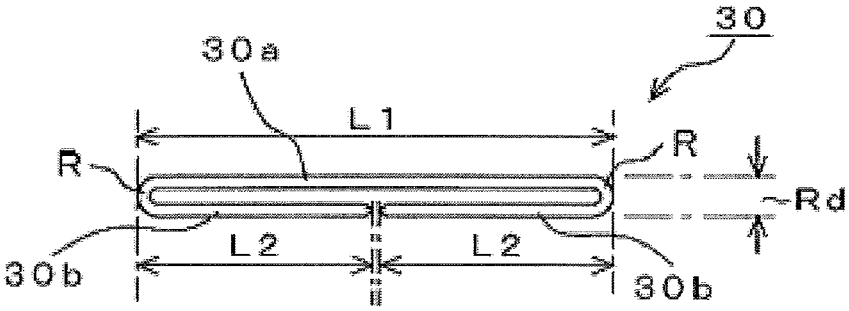
[FIG. 6B] is a front view of the preferable staple 30 for showing a bent state thereof.

In this embodiment, if the length L2 of each of the pair of legs 30*b* is set to be 6.0 mm, a relationship of L1 (11.49 mm)<L2 (6.0 mm)×2 may occur so that the forward ends of the legs 30*b* may contact with each other. However, some thickness Rd is generated on each bent portion R when clinching the staple 30 (see FIG. 6B) so that even if the sum of the lengths L2 of the legs 30*b* of the staple 30 is some longer than the whole length L1 of the crown portion 30*a* of the staple 30, the forward ends of the legs 30*b* may not contact with each other.

Figure 7:
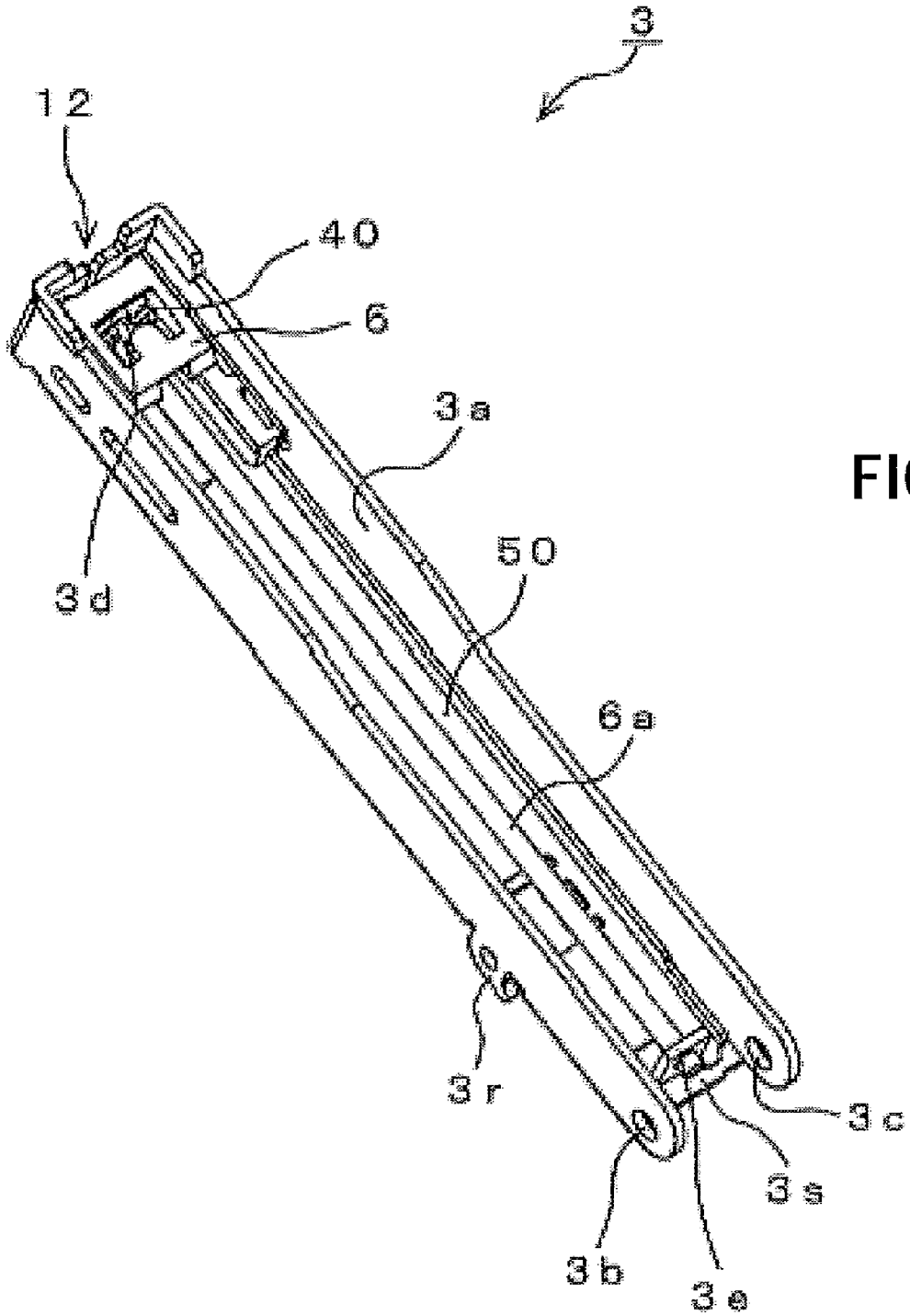
[FIG. 7] is a perspective view of an assembly of a magazine 3 and parts relating thereto for showing an assembled example.

The following will describe a configuration of the magazine 3 assembled by the pusher 6, the staple-pushing member 40, and a staple guide 50 with reference to FIG. 7. The staple guide 50 is slidably mounted on bottom of the main frame 3*a* of the magazine 3 shown in FIG. 7. This staple guide 50 is biased toward the staple-pushing-out slit 12 of the magazine 3 by a spring 3*i* (see FIG. 12A).

At a forward portion of the magazine 3, a front attaching portion 3*d* in which a part of the bottom of the magazine 3 is bent at about right angles and a middle portion thereof has circular hole 3*f* is provided. A forward end of a spring guide 6*a* constituting an axial guide member is fit into the circular hole 3*f* of the front attaching portion 3*d* (see FIG. 8). Further, at a rear portion of the magazine 3, a rear attaching portion 3*e* in which a part of the bottom of the magazine 3 is bent at about right angles and a middle portion thereof has circular hole 3*g* is provided. A rear end of the spring guide 6*a* is fit into the circular hole 3*g* of the rear attaching portion 3*e* (see FIG. 8). A rear end of this spring guide 6*a* is prevented from slipping out by the main shaft 21 inserted into the holes 3*b*, 3*c* of the magazine 3 (see FIG. 1).

The spring guide 6*a* is inserted into the pusher 6 so that the pusher 6 is slidably put on the spring guide 6*a*. Further, the pusher 6 is biased toward the staple-pushing-out slit 12 by the spring 6*b* shown in FIG. 14A and pushes the strip of staples 300 loaded in the magazine to a side of the staple-pushing-out slit 12.

Figure 8:
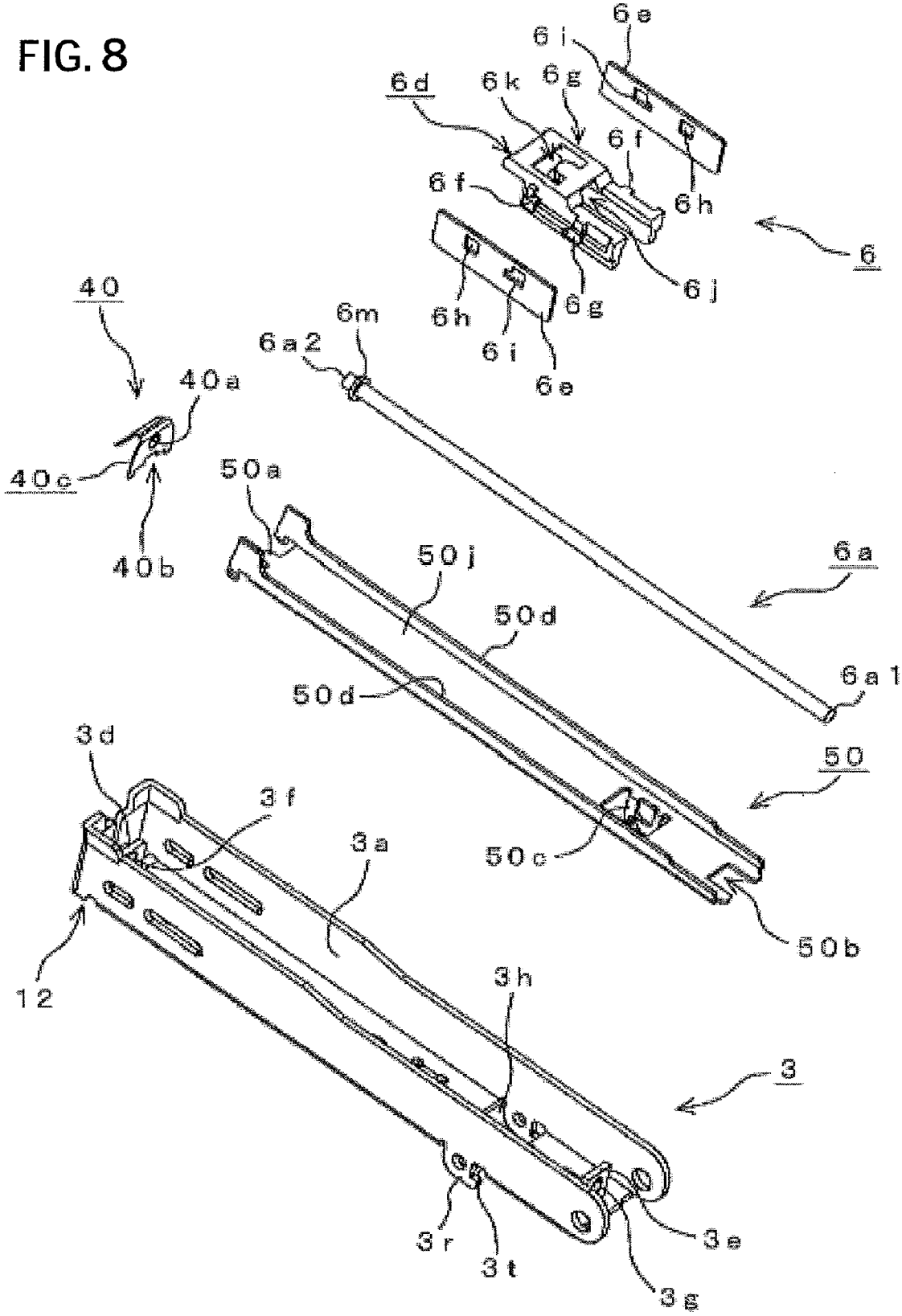
[FIG. 8] is an exploded perspective view of the assembly of the magazine 3 and the parts relating thereto.

The following will describe how to assemble the pusher 6, the staple-pushing member 40, and the staple guide 50 to the magazine 3 with reference to FIG. 8. It is to be noted that a configuration of each part will be also described at the same time.

Nothing is assembled into the magazine 3 shown in FIG. 8. This magazine 3 has an insertion opening 3*m* at a base of the front attaching portion 3*d* of the magazine 3 (see FIG. 9B). An insert portion 50*a* provided on a forward end of a guide main body 50*j* of the staple guide 50 is inserted into the insertion opening 3*m* and a spring-receiving portion 50*c* provided on the staple guide 50 is fit into a rectangular opening 3*h* provided on a bottom of a main frame 3*a* of the magazine 3. Thereafter, the spring-receiving portion 50*c* receives an end of the spring 3*i* (see FIG. 12A) and another spring-receiving portion 3*k* provided on the bottom of the magazine 3 receives the other end of the spring 3*i* (see FIG. 12A).

It is to be noted that this staple guide 50 slides within a range where the spring-receiving portion 50*c* can move in the rectangular opening 3*h*. This range is set so as to be some longer than the thickness L3 of the crown portion 30*a* of the staple 30 (see FIG. 3A). This is because the crown portion 30*a* of the top staple 30 of the strip of staples loaded in the magazine 3 contacts a top of the staple guide 50 biased toward a side of the staple-pushing-out slit 12 of the magazine 3 when driving the top staple 30 downwards, and moves the staple guide 50 rearwards.

After the staple guide 50 has been thus assembled to the magazine 3, the pusher 6 and the staple-pushing member 40 are assembled to the magazine 3. This pusher 6 is constituted of a pusher main body 6*d* and right and left pusher plates 6*e*, 6*e*. The pusher main body 6*d* is positioned inside the staple guide 50. Into the pusher main body 6*d*, an end of the pusher band 6*c* is inserted (see FIG. 14B), so that the pusher band 6*c* is fixed to the pusher main body 6*d*.

The right and left pusher plates 6*e*, 6*e* constitute first and second pushing plates and are connected to both sides of the pusher main body 6*d* while the pusher plates 6*e*, 6*e* are respectively set across side guide members 50*d*, 50*d* on both sides of the staple guide 50. The pusher plates 6*e*, 6*e* come into contact with the strip of staples 300 guided by the staple guide 50.

The pusher 6 is formed so that the pusher main body 6*d* and the right and left pusher plates 6*e*, 6*e* are molded in a body or they are separately manufactured. For example, when manufacturing them separately, the pusher main body 6*d* is molded by injection-molding any plastic material. For example, the pusher plates 6*e*, 6*e* are formed by cutting out metal plate using a press machine. Alternatively, when molding them in a body, the pusher main body 6*d* and the right and left pusher plates 6*e*, 6*e* are molded so that they are previously united by, for example, injection-molding any plastic material.

In this embodiment, the separately manufactured pusher main body 6*d* has two different shaped projections 6*f*, 6*g* on each side thereof in order to connect these pusher plates 6*e*, 6*e*. For example, the projection 6*f* is formed as a rectangular parallelepiped and the projection 6*g* is formed as a rectangular parallelepiped in which a piece is cut off. The projections 6*f*, 6*g* provided on each side of the pusher main body 6*d* constitute first and second coupling members.

These projections 6*f*, 6*g* are arranged in different order on each side of the pusher main body 6*d*. In this embodiment, on a left side of the pusher main body 6*d*, the projection 6*f* is arranged in front of the projection 6*g*. Further, on a right side of the pusher main body 6*d*, the projection 6*g* is arranged in front of the projection 6*f*.

Each of the pusher plates 6*e*, 6*e* has two apertures 6*h*, 6*i* for allowing these projections 6*f*, 6*g* to be fitted. In this embodiment, the aperture 6*h* has a rectangular shape and the aperture 6*i* has a part-projecting rectangular shape.

These projections 6*f*, 6*g* and these apertures 6*h*, 6*i* are so formed as to be different shapes along a direction of movement thereof, so that the pusher main body 6*d* and each of the pusher plates 6*e* can be assembled in a fixed direction. In this embodiment, left-side pusher plate 6*e* is fitted to the pusher main body 6*d* with it being rotated by 180 degrees against the right-side pusher plate 6*e* (their forward and rear ends are respectively reversed). It is to be noted that although the order of the projections 6*f*, 6*g* has been changed on each side of the pusher main body 6*d*, this invention is not limited thereto; the order of the projections 6*f*, 6*g* may be not changed on each side of the pusher main body 6*d*. In this case, the right and left pusher plates 6*e*, 6*e* are assembled to the pusher main body 6*d* with them being directed to the same direction.

The pusher main body 6*d* is provided with a band insertion portion 6*j* on its upper portion. To this band insertion portion 6*j*, the forward end of the pusher band 6*c* (see FIG. 14B) is inserted and fixed. The rear end of the pusher band 6*c* is fixed to the staple cover 7 (see FIG. 1). The pusher 6 is pulled by the pusher band 6*c* in the opposite direction of the pushing direction of the staple 30 by the pusher in response to rotation operation (open operation) of this staple cover 7, and moved rearwards to the reap side of the magazine 3. The pusher main body 6*d* is provided with an engaging groove 6*k* therein. With this engaging groove 6*k*, the spring guide 6*a* is engaged.

The staple-pushing member 40 has a function such that the staple 30 pushed out of the staple-pushing-out slit 12 of the magazine 3 is pushed against a front inner wall of the magazine 3 and is held thereon. This staple-pushing member 40 is formed by bending a metal plate in almost half so as to have a curved shape by which elasticity is held. In this embodiment, thin plate member is bent so as to have a curved shape. The staple-pushing member 40 contains an attaching portion 40*c* which has hole 40*a* as second circular hole at a middle thereof. Further, a rear end 40*b* of this attaching portion 40*c* forms a step portion and this attaching portion 40*c* is used for fixing the staple guide 50 to the bottom of the main frame 3*a* of the magazine 3 when inserting the insert portion 50*a* of the staple guide 50 into the bottom thereof.

The staple-pushing member 40 and the pusher 6, which are thus formed, are assembled to the magazine 3 to which the staple guide 50 has already assembled. First, the pusher plates 6*e*, 6*e* are assembled to the pusher main body 6*d*. For example, the projections 6*f* of the pusher main body 6*d* are fit into the apertures 6*h* formed on the pusher plates 6*e* and the projections 6*g* are fit into the apertures 6*i* so that the pusher plates 6*e*, 6*e* can be coupled into both sides of the pusher main body 6*d*. Next, the spring guide 6*a* is inserted into the pusher 6 from a front of the pusher 6 and engages with the engaging groove 6*k* of the pusher 6. The spring 6*b* is then equipped with the spring guide 6*a* (see FIG. 14A). Thus, the spring guide 6*a* is positioned between the engaging groove 6*k* and the band insertion portion 6*j* so that the spring guide 6*a* can be fitted into the pusher 6 with some play therebetween.

Figure 9A:
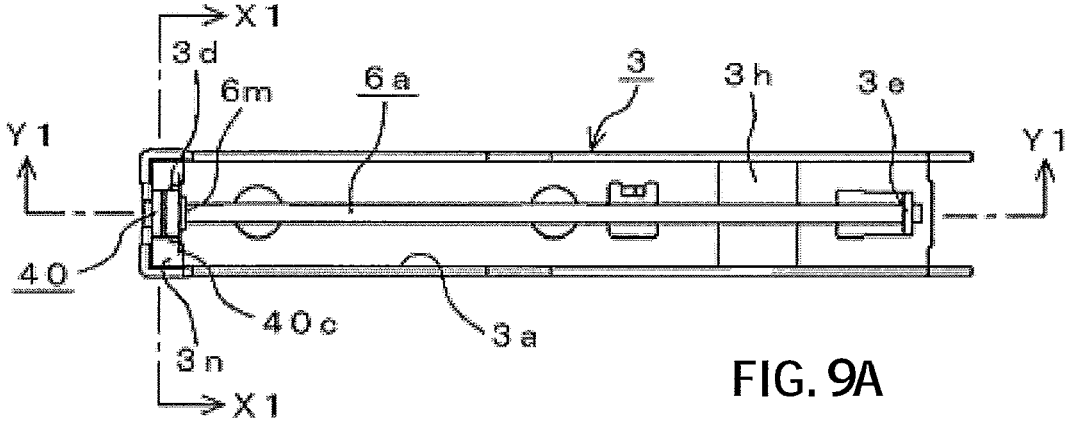
[FIG. 9A] is a top view of the magazine 3 for showing an attachment of a staple-pushing member 40 thereto.

After the pusher 6 has thus equipped, the rear end 40*b* of the staple-pushing member 40 is inserted into an opening 3*n* formed in the bottom of the main frame 3*a* with striding across the front attaching portion 3*d* of the magazine 3 while the forward end of the staple-pushing member 40 faces a front inner wall of the magazine 3 (see FIG. 9A). The staple-pushing member 40 is then positioned to the front attaching portion 3*d* so as to align the hole 40*a* of the staple-pushing member 40 and the circular hole 3*f* of the front attaching portion 3*d* as a first hole. Next, a rear end portion 6*a*1 of the spring guide 6*a* setting up the pusher 6 is inserted into the circular hole 3*g* of the rear attaching portion 3*e* of the magazine 3 and a forward end portion 6*a*2 of the spring guide 6*a* is then inserted into the hole 40*a* of the staple-pushing member 40 and the circular hole 3*f* of the front attaching portion 3*d*. In this moment, the attaching portion 40*c* of the staple-pushing member 40 is pushed against the front attaching portion 3*d* by a stopper 6*m* provided as a stopping member at the forward end portion 6*a*2 of the spring guide 6*a* so that the attaching portion 40*c* of the staple-pushing member 40 can be held between the stopper 6*m* of the spring guide 6*a* and the front attaching portion 3*d* of the magazine 3. The rear end portion 6*a*1 of the spring guide 6*a* is then prevented from slipping out by the main shaft 21 (see FIG. 1). Thus, the staple-pushing member 40 and the pusher 6 are assembled to the magazine 3. It is to be noted that the right and left pusher plates 6*e*, 6*e* are respectively positioned in spaces between the side guide members 50*d*, 50*d* of the staple guide 50 and inner walls of the main frame 3*a* of the magazine 3. Further, the pusher main body 6*d* is positioned between the side guide members 50*d*, 50*d* of the staple guide 50. Additionally, the side guide members 50*d*, 50*d* of the staple guide 50 is formed so as to stay low on a guide main body 50*j* so that they cannot contact the projections 6*f*, 6*g* coupling the pusher main body 6*d* to the right and left pusher plates 6*e*, 6*e* when assembling the pusher 6 to the magazine 3.

The following will describe in detail how to attach the staple-pushing member 40 and an assembly when attaching it. FIG. 9A shows the assembly of the magazine 3, the spring guide 6*a*, and the staple-pushing member 40. It is to be noted that in this embodiment, the pusher 6 and the staple guide 50 shown in FIGS. 7 and 8 are not illustrated in the magazine 3 shown in FIG. 9A.

The staple-pushing member 40 shown in FIG. 9A is attached to the front attaching portion 3*d* of the magazine 3 by the spring guide 6*a*. In this embodiment, the rear end 40*b* of the attaching portion 40*c* of the staple-pushing member 40 (see FIG. 8) is inserted into the opening 3*n* formed in the bottom of the main frame 3*a* of the magazine 3 and this attaching portion 40*c* is held between the stopper 6*m* of the spring guide 6*a* and the front attaching portion 3*d* of the magazine 3. This enables the staple-pushing member 40 to be assembled into the magazine 3 without any requirement of addition of new fitting parts and an extensive change in the design. It is to be noted that the forward end portion of the staple-pushing member 40 is arranged so as to contact the front inner wall of the magazine 3.

Figure 9B:
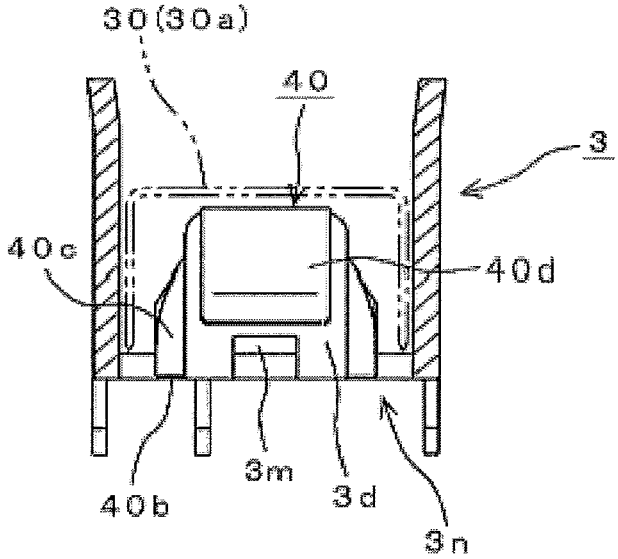
[FIG. 9B] is a sectional view of the magazine 3, taken on line X1-X1 shown in FIG. 9A, for showing the attachment of the staple-pushing member 40 thereto.

FIG. 9B shows the attachment example of the staple-pushing member 40 to the magazine 3 in the assembly shown in FIG. 9A. It is to be noted that the staple 30 is drawn by a chain double-dashed line in FIG. 9B. The staple-pushing member 40 shown in FIG. 9B is provided with an elastic pushing portion 40*d* at its forward side. The staple-pushing member 40 is positioned so as to push the middle of the crown portion 30*a* of the staple 30 by means of this elastic pushing portion 40*d* during the descending course of the staple 30.

Figure 10A:
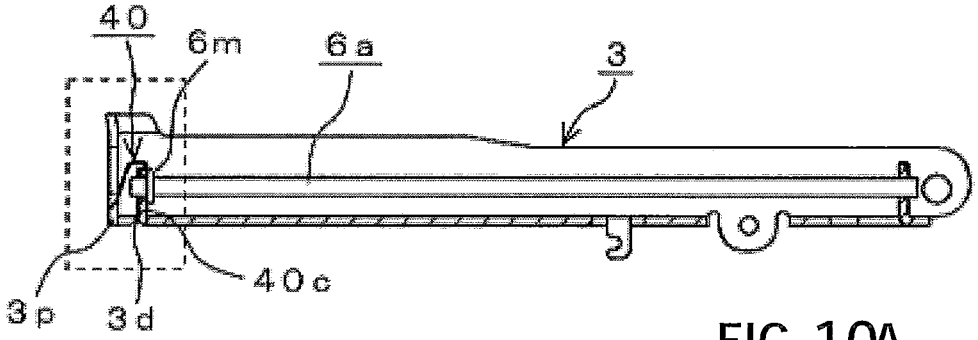
[FIG. 10A] is a sectional view of the magazine 3, taken on line Y1-Y1 shown in FIG. 9A, for showing the attachment of the staple-pushing member 40 thereto.

FIG. 10A also shows the attachment example of the staple-pushing member 40 to the magazine 3 in the assembly shown in FIG. 9A. FIG. 10B shows an enlarged part enclosed by broken lines shown in FIG. 10A. The rear end 40*b* of the attaching portion 40*c* of the staple-pushing member 40 shown in FIG. 10B is inserted into the opening 3*n* formed in the bottom of the main frame 3*a* of the magazine 3. Further, the attaching portion 40*c* of the staple-pushing member 40 is held between the stopper 6*m* of the spring guide 6*a* and the front attaching portion 3*d* of the magazine 3 and is fixed. The forward end portion of the elastic pushing portion 40*d* of the staple-pushing member 40 is arranged so as to contact the front inner wall of the magazine 3 and extend into an opening 3*p* in the front inner wall thereof.

Thus, the stapler 100 according to this invention is provided with the staple-pushing member 40 that pushes the staple 30 pushed out of the staple-pushing-out slit 12 of the magazine 3 against the front inner wall of the magazine 3 to hold the staple 30 and fixes the staple-pushing member 40 to the front attaching portion 3*d* of the magazine 3 to be installed in the magazine 3.

The following will describe more in detail how to attach the staple guide 50 and an assembly when attaching it. FIG. 11A shows the assembly of the magazine 3 and the staple guide 50. It is to be noted that in this embodiment, the pusher 6, the spring guide 6*a*, and the staple-pushing member 40 shown in FIGS. 7 and 8 are not assembled into the magazine 3 in FIG. 11A.

The insert portion 50*a* of the staple guide 50 is inserted into the insertion opening 3*m* (see FIG. 9B) of the magazine 3 shown in FIG. 11A and is fitted. Further, a spring-receiving portion 50*c* of the staple guide 50 is fit into the rectangular opening 3*h* of the magazine 3.

Figure 11B:
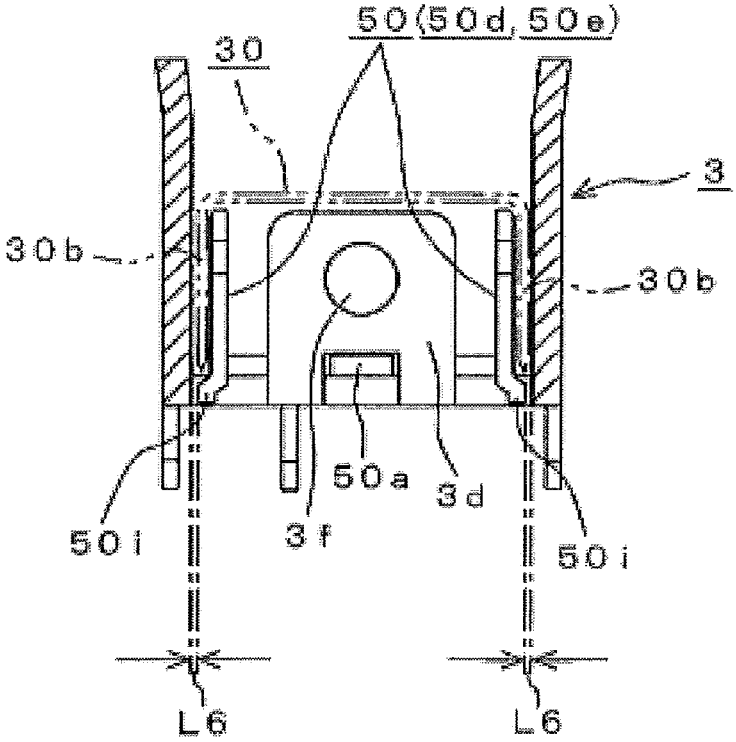
[FIG. 11B] is a sectional view of the magazine 3, taken on line X2-X2 shown in FIG. 11A, for showing the attachment of the staple guide 50 thereto.

FIG. 11B shows the attachment example of the staple guide 50 to the magazine 3 in the assembly shown in FIG. 11A. It is to be noted that the staple 30 is drawn by a chain double-dashed line in FIG. 11B. The staple guide 50 shown in FIG. 11B is positioned so that a space between each of the side guide members 50*d* thereof and each of the inner walls of the magazine 3 is almost equal to the thickness L4 of each of the legs 30*b* of the staple 30 (see FIG. 3B). This prevents the legs 30*b* of the staple 30 from rattling, thereby enabling guide accuracy of the staple guide 50 to be improved.

Elastic portions 50*e*, 50*e* each having an inverse U shape are provided on both sides of the forward end of the staple guide 50 with them facing to each other (see FIG. 12B). These elastic portions 50*e* support the legs 30*b* of the staple 30 driven out of the staple-pushing-out slit 12 of the magazine 3 and being descending. The elastic portions 50*e* are positioned so that a space L6 between each of the forward ends 50*i*, 50*i* thereof and each of the inner walls of the magazine 3 is narrower than the thickness L4 of each of the legs 30*b* of the staple 30.

When the legs 30*b* of the descending staple 30 pass through the spaces L6 between each of the forward ends 50*i*, 50*i* of the elastic portions 50*e*, 50*e* and each of the inner walls of the magazine 3, the legs 30*b*, 30*b* contact the forward ends 50*i*, 50*i* of the elastic portions 50*e*, 50*e*. In this moment, the forward ends 50*i* of the elastic portions 50*e*, 50*e* are bent inwardly by the legs 30*b* and push the legs 30*b*, 30*b* against the inner side walls of the magazine 3. After the legs 30*b* passes therethrough, the forward ends 50*i*, 50*i* of the elastic portions 50*e*, 50*e* return to original positions thereof. This enables the legs 30*b* of the staple 30 to descend with them being closely connected to the inner side walls of the magazine 3 and to drive out the legs 30*b* perpendicularly to a stack of paper. Accordingly, the stapler 100 may obtain stable clinching.

Figure 12A:
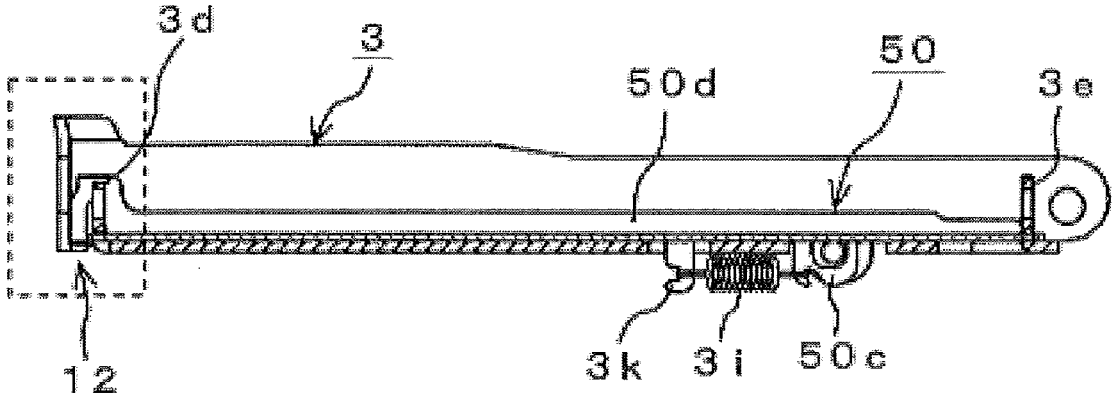
[FIG. 12A] is a sectional view of the magazine 3, taken on line Y2-Y2 shown in FIG. 11A, for showing the attachment of the staple guide 50 thereto.
Figure 12A:
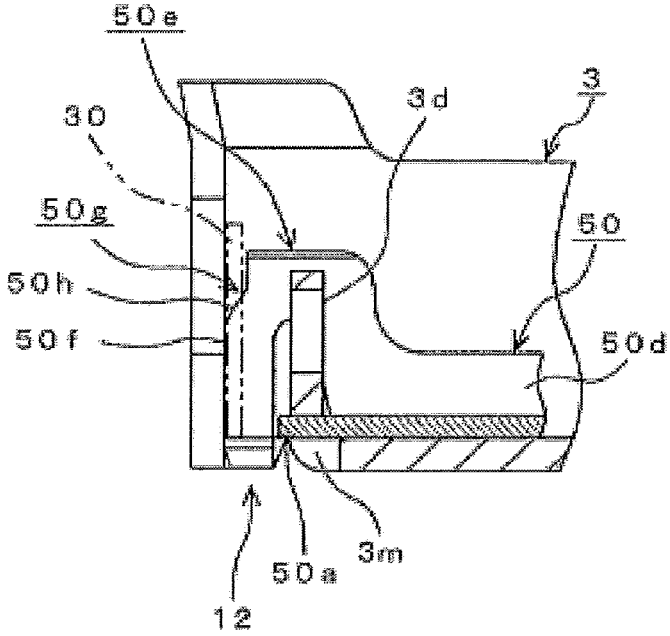

FIG. 12A also shows the attachment example of the staple guide 50 to the magazine 3 in the assembly shown in FIG. 11A. FIG. 12B shows an enlarged part enclosed by broken lines shown in FIG. 12A. The spring-receiving portion 50*c* of the staple guide 50 shown in FIG. 12A is engaged with the spring-receiving portion 3*k* of the magazine 3 through the spring 3*i*. Accordingly, the staple guide 50 is slidably biased to a direction of the staple-pushing-out slit 12 of the magazine 3.

Forward end surfaces 50*f*, 50*f* of the elastic portions 50*e*, 50*e* provided on the forward end of the staple guide 50 contact the front inner wall of the magazine 3. On the forward end surfaces 50*f*, 50*f* on the elastic portions 50*e*, 50*e*, receiving portion 50*g*, 50*g* are provided. These receiving portions 50*g*, 50*g* are formed so as to have slant portions 50*h*, 50*h* by obliquely cutting off a part of each of the forward end surfaces 50*f*, 50*f*.

These receiving portions 50*g* receive the crown portion 30*a* of the staple 30 when the staple 30 descends and the crown portion 30*a* are slidably contacted on the slant portions 50*h*,

50*h* of the receiving portions 50*g*. The slidable contact of the crown portion 30*a* enables the slant portions 50*h* of the staple guide 50 to move rearwards and also, the staple guide 50 to move rearwards. Thus, the staple guide 50 is assembled to the magazine 3.

Figure 13:
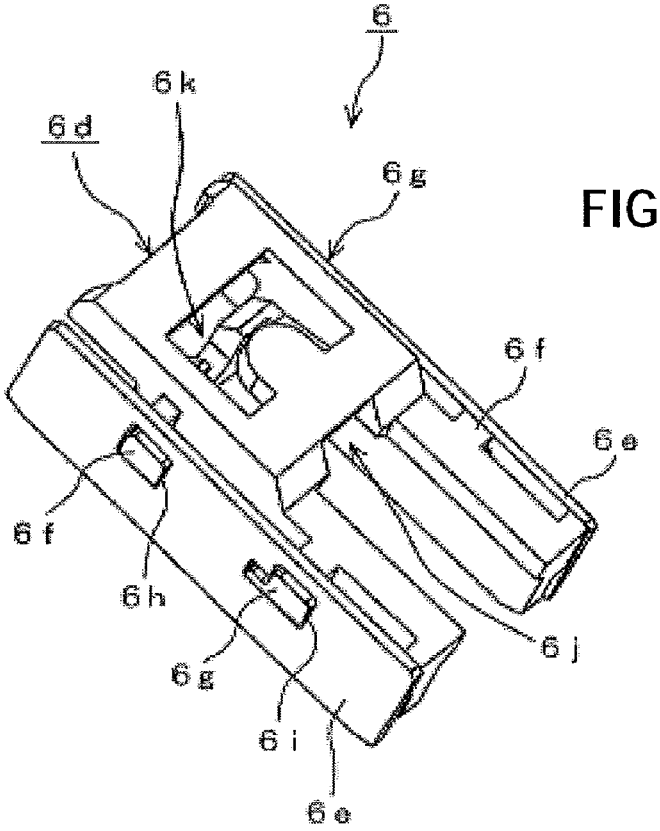
[FIG. 13] is a perspective view of a pusher 6 for showing a configuration example thereof.

The following will describe a configuration of the pusher 6. FIG. 13 shows the pusher 6 in which the pusher plates 6*e* are connected to both sides of the pusher main body 6*d*. As described relating to FIG. 8, the projections 6*f*, 6*g* having different shapes provided on the pusher main body 6*d* are arranged in different order on each side of the pusher main body 6*d*. In this embodiment, on a left side of the pusher main body 6*d*, the projection 6*f* is arranged in the front of the projection 6*g*. On a right side of the pusher main body 6*d*, the projection 6*g* is arranged in front of the projection 6*f*.

To the aperture 6*h* of the left-side pusher plate 6*e*, the projection 6*f* of the pusher main body 6*d* is fitted while to the aperture 6*i* thereof, the projection 6*g* is fitted. On the other hand, on the right-side pusher plate 6*e*, the projections 6*f*, 6*g* are respectively fitted to the apertures 6*h*, 6*i*. This right-side pusher plate 6*e* is assembled to the pusher main body 6*d* with the right-side pusher plate 6*e* being rotated by 180 degrees against the left-side pusher plate 6*e* and the order thereof being changed because the projections 6*f*, 6*g* are arranged in different order.

Figure 14A:
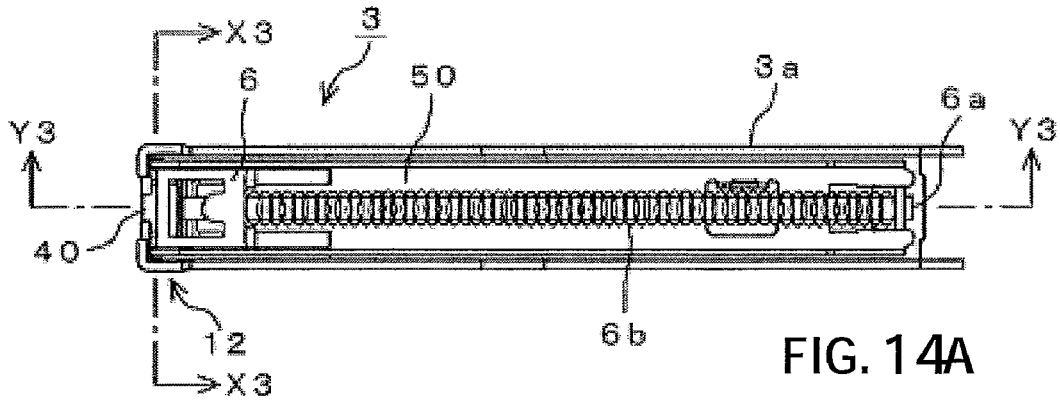
[FIG. 14A] is a top view of the magazine 3 for showing an attachment of the pusher 6 thereto.

FIG. 14A shows an assembly of the magazine 3, the pusher 6, the spring guide 6*a*, the staple-pushing member 40, and the staple guide 50.

Figure 14B:
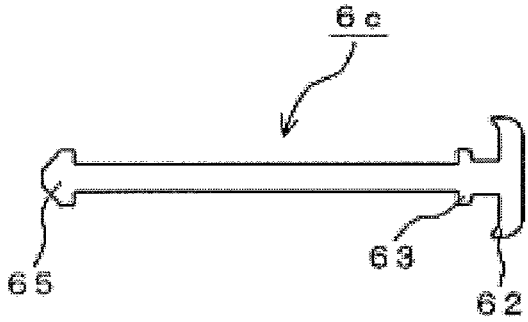
[FIG. 14B] is a top view of a pusher band 6*c* to be assembled to the pusher 6 for showing a configuration example thereof.
Figure 14C:
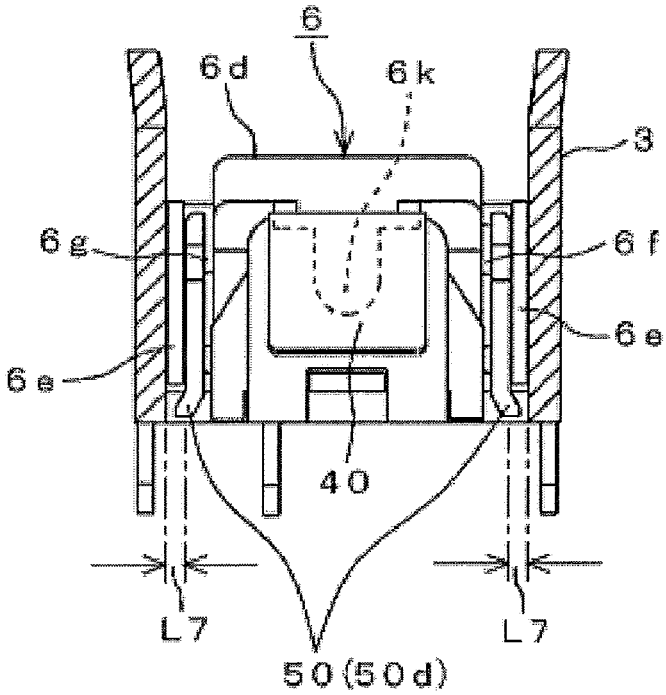
[FIG. 14C] is a sectional view of the magazine 3, taken on line X3-X3 shown in FIG. 14A, for showing the attachment of the pusher 6 thereto.

The pusher 6 shown in FIG. 14A is slidably put on the spring guide 6*a* with the spring guide 6*a* engaging with the engaging groove 6*k* of the pusher 6 (see FIG. 14C). Concerning this pusher 6, the spring 6*b* biases the pusher 6 to the direction of the staple-pushing-out slit 12 of the magazine 3.

FIG. 14B shows a configuration example of the pusher band 6*c* to be incorporated into the pusher 6. The pusher band 6*c* is constituted of a thin plate and has a predetermined length. The pusher band 6*c* contains a forward end 65, a T-shaped portion 62, and a protruding portion 63. For example, the pusher band 6*c* is made of synthetic resin. The forward end 65 of the pusher band 6*c* is inserted into the band insertion portion 6*j* of the pusher main body 6*d* shown in FIG. 13 with the forward end 65 being once bent and then, the forward end 65 returns to a flat state thereof so as to be locked. The T-shaped portion 62 and the protruding portion 63 are incorporated into the staple cover 7 shown in FIG. 1 through the opening thereof.

FIG. 14C shows the attachment example of the pusher 6 shown in FIG. 14A. Within the spaces L7 between the side guide members 50*d* of the staple guide 50 and the inner side walls of the magazine 3, the pusher plates 6*e* of the pusher 6 are positioned. Thickness of each of the pusher plates 6*e* is set so as to be almost equal to the space L7. The pusher plates 6*e*, 6*e* are fixed to the pusher main body 6*d* by fitting the projections 6*f*, 6*g* of the pusher main body 6*d* shown in FIG. 8 thereto.

Thus, in the stapler 100 according to this invention, the pusher 6 having the pusher main body 6*d*, into which the forward end 65 of the pusher band 6*c* is incorporated, and the right and left pusher plates 6*e*, 6*e* contacting the staple 30, which are provided on both side of the pusher main body 6*d*, is positioned inside the staple guide 50.

Therefore, it is possible to incorporate an end of the pusher band 6*c* into the pusher main body 6*d* in the staple 30 having the staple guide 50 without adding any attachment parts. This allows a height of the pusher main body 6*d* to be suppressed so as to be made low and a size of the pusher 6 to be made compact. Further, the pusher 6 may introduce a configuration, by pusher plates 6*e*, 6*e* made of any metal sheets, having a predetermined strength.

Figure 15A:
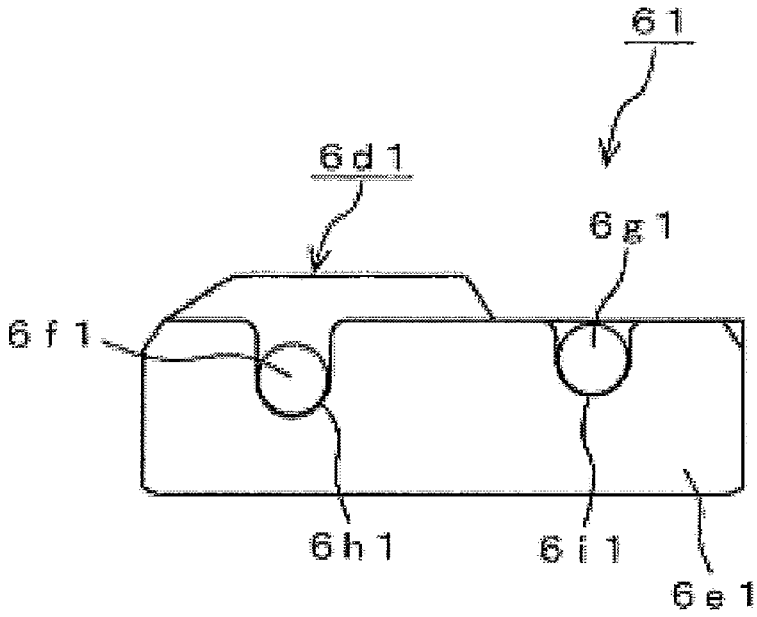
[FIG. 15A] is a side view of another pusher 61 for showing a configuration example thereof.
Figure 15B:
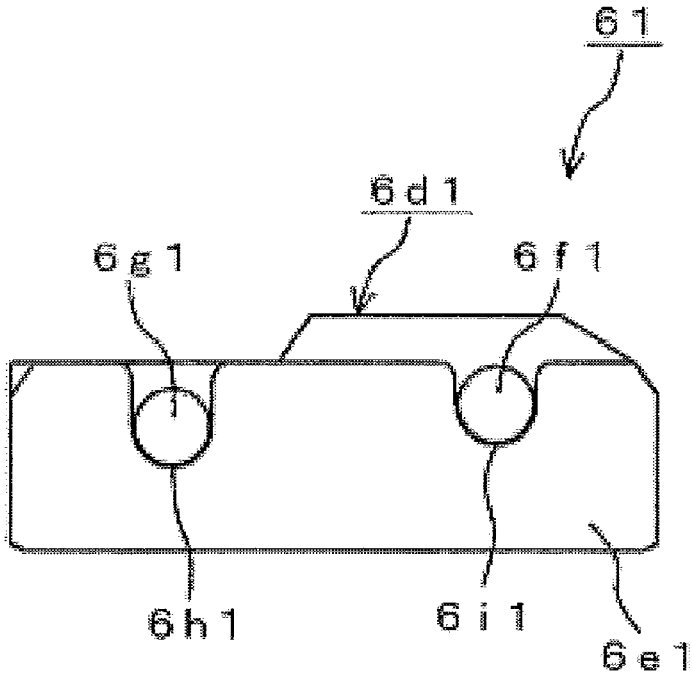
[FIG. 15B] is the other side view of the above-mentioned another pusher 61 for showing a configuration example thereof.

The following will describe another configuration of the pusher 6. FIGS. 15A and 15B show a configuration example of such a pusher 61. The pusher 61 shown in FIG. 15A contains a pusher main body 6*d*1, projections 6*f*1, 6*g*1, and right and left pusher plates 6*e*1, 6*e*1.

The right and left pusher plates 6*e*1, 6*e*1 are formed so as to have the same shape and have fitting grooves 6*h*1, 6*i*1. The fitting groove 6*h*1 is formed so as to be deeper than the fitting groove 6*i*1.

The pusher main body 6*d*1 has two projections 6*f*1, 6*g*1 on each side surface thereof in order to couple the pusher plates 6*e*1, 6*e*1. For example, these projections 6*f*1, 6*g*1 are formed so as to be round column.

The projections 6*f*1, 6*g*1 are set so as to change the attached order thereof on each side surface of the pusher main body 6*d*1. In this embodiment, on the left side surface of the pusher main body 6*d*1 shown in FIG. 15A, the projection 6*f*1 positioned at a forward position of the pusher main body 6*d*1 is positioned so as to be lower than the projection 6*g*1 positioned at a rear position of the pusher main body 6*d*1. Further, on the right side surface of the pusher main body 6*d*1 shown in FIG. 15B, the projection 6*f*1 positioned at a forward position of the pusher main body 6*d*1 is positioned so as to be higher than the projection 6*g*1 positioned at a rear position of the pusher main body 6*d*1.

Accordingly, the right-side pusher plates 6*e*1, 6*e*1 shown in FIG. 15B are fitted to the pusher main body 6*d*1 with them being reversed in order of the plate by 180 degrees against the left-side pusher plates 6*e*1, 6*e*1 shown in FIG. 15A.

Figure 16A:
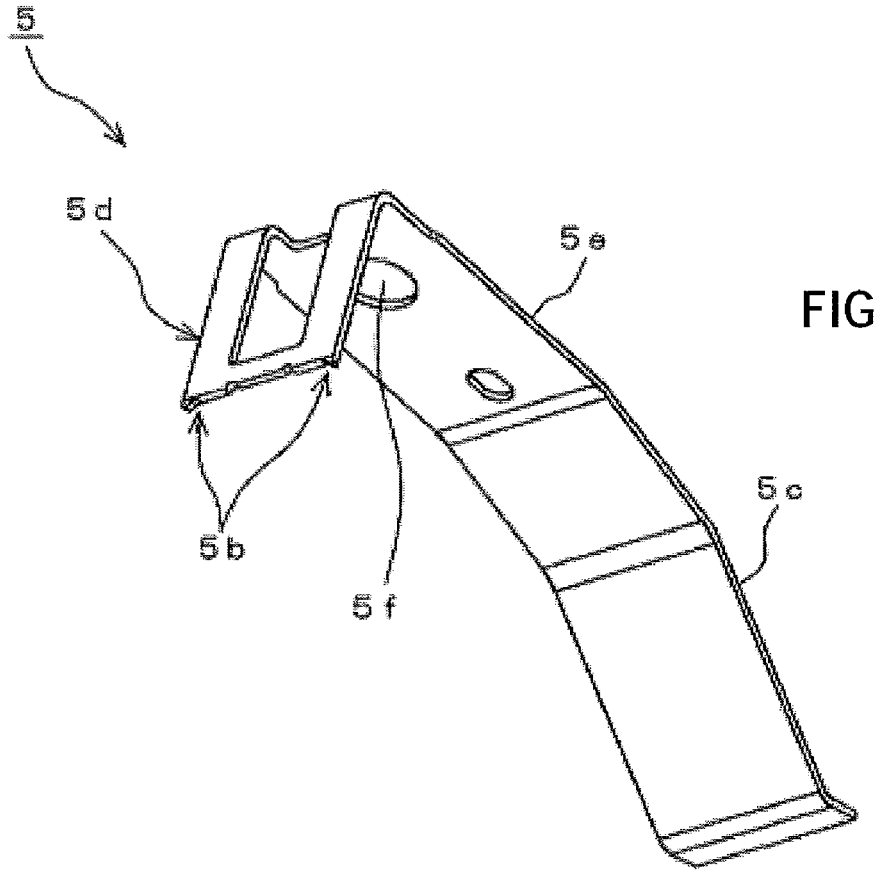
[FIG. 16A] is a whole perspective view of a driver 5 for showing a configuration example of the driver 5.

The following will describe a configuration of the driver 5. The driver 5 shown in FIG. 16A is provided with an elastic portion 5*c*, a driving portion 5*d*, and an attaching portion 5*e*. The driver 5 is fixed to the driver arm 4 shown in FIG. 1 by fitting a boss, not shown, formed circularly on the driver arm 4 by a burring process or the like to an opening 5*f* of the attaching portion 5*e* of the driver 5. The driver 5 thus fixed keeps constant a space between the driver arm 4 and the magazine 3 at a stand-by time of the stapler 100 by contacting the curved elastic portion 5*c* with the staple cover 7 mounted on the magazine 3 as shown in FIG. 1.

The driver 5 is provided with the driving portion 5*d* on a forward end thereof. The driving portion 5*d* of the driver 5 drives the top staple 30 of the strip of staples 300 loaded in the magazine 3 to push it out of an inside of the magazine 3 to an outside when the driver arm 4 shown in FIG. 1 is rotated.

Figure 16B:
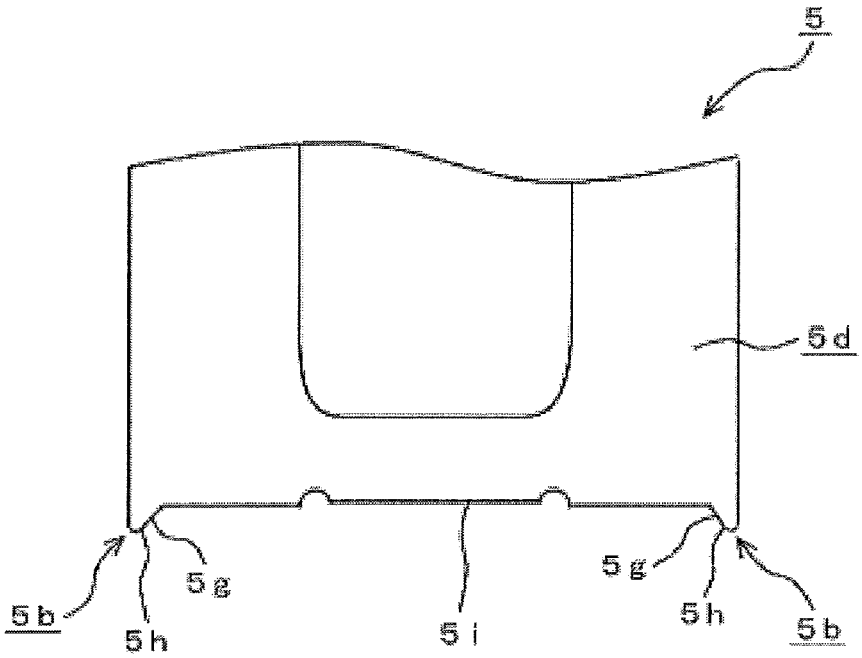
[FIG. 16B] is an enlarged front view of an important portion of the driver 5 for showing a configuration example of a driving portion 5*d* of the driver 5.

The driving portion 5*d* is provided with projections 5*b*, 5*b* and a level portion 5*i* on a forward end thereof (see FIG. 16B). The projections 5*b*, 5*b* are positioned on both sides of the driving portion 5*d* and contact positions of the staple 30 supported by the staple guide 50 (see FIG. 11B) over the legs 30*b*, 30*b*. The level portion 5*i* contacts the crown portion 30*a* of the staple 30 after the projections 5*b*, 5*b* have contacted the positions of the staple 30 over the legs 30*b*, 30*b* and drives the staple 30 out of the magazine 3.

Each of the projections 5*b*, 5*b* provided on both sides of the forward end of the driving portion 5*d* shown in FIG. 16B contains a tapered portion 5*g* and a contacting portion 5*h*. The contacting portion 5*h* is provided on a forward end of each of the projections 5*b*, 5*b* and contacts the position of the staple 30 over the leg 30*b*. The tapered portion 5*g* is formed so as to have a predetermined incline against the level portion 5*i* of the driving portion 5*d* of the driver 5. These tapered portions 5*g*, 5*g* make the crown portion 30*a* of the staple 30 curved somewhat when the staple 30 is driven out. This enables any reaction force applied to each of the legs 30*b*, 30*b* of the staple 30 by the stack of paper to be canceled by this curved crown portion 30*a*.

Figure 17:
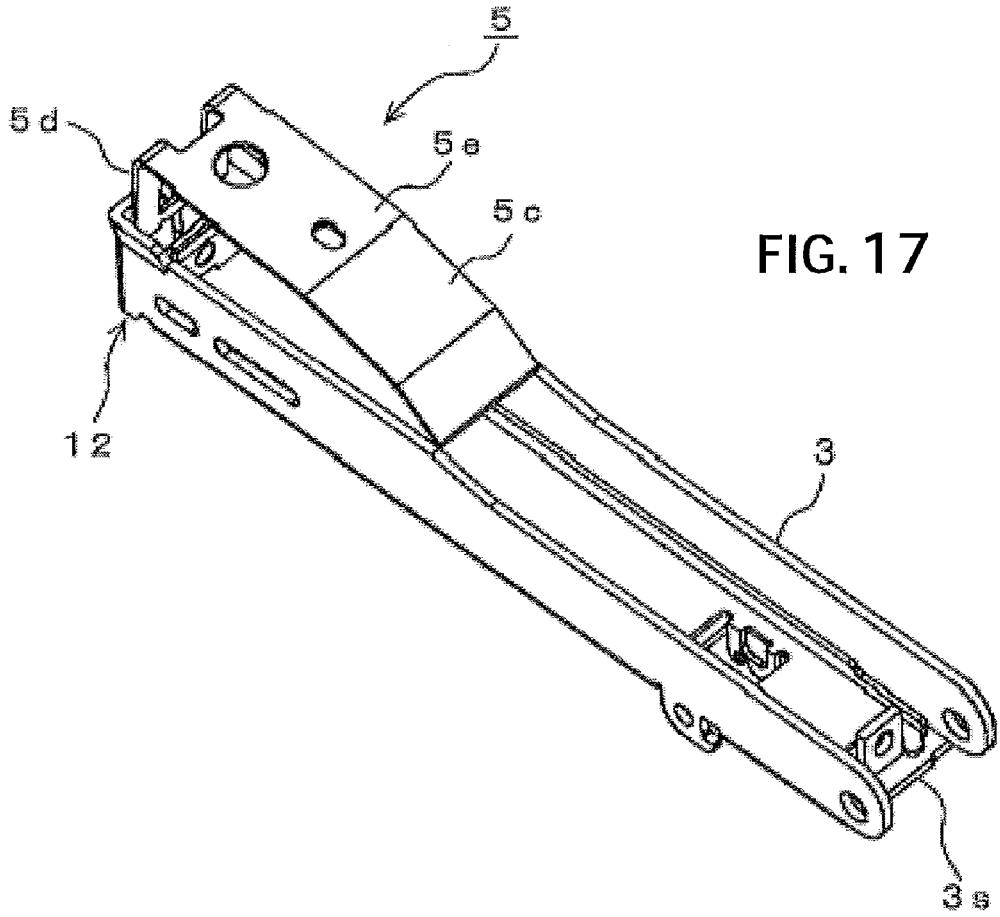
[FIG. 17] is a perspective view of an assembly of the driver 5 and the magazine 3.

FIG. 17 shows an arrangement example of an assembly of the driver 5 and the magazine 3. The driver 5 shown in FIG. 17 is assembled to the magazine 3 so as to be positioned onto the forward end portion of the magazine 3. In this moment, the driving portion 5*d* of the driver 5 is positioned over the staple-pushing-out slit 12 of the magazine 3. Namely, the driver 5 is set so that when driving the driver 5 downwards, the forward end of the driving portion 5*d* of the driver 5 approaches to the front inner wall of the magazine 3.

The following will describe operations of the driver 5, the staple-pushing member 40, and the staple guide 50. FIGS. 18A through 18D show an operation example of the driver 5 and the staple guide 50. FIGS. 18A through 18D show the magazine 3 on which the staple guide 50 is mounted and in which the strip of staples 300 is loaded, taken on line X2-X2 shown in FIG. 11A.

Figure 18A:
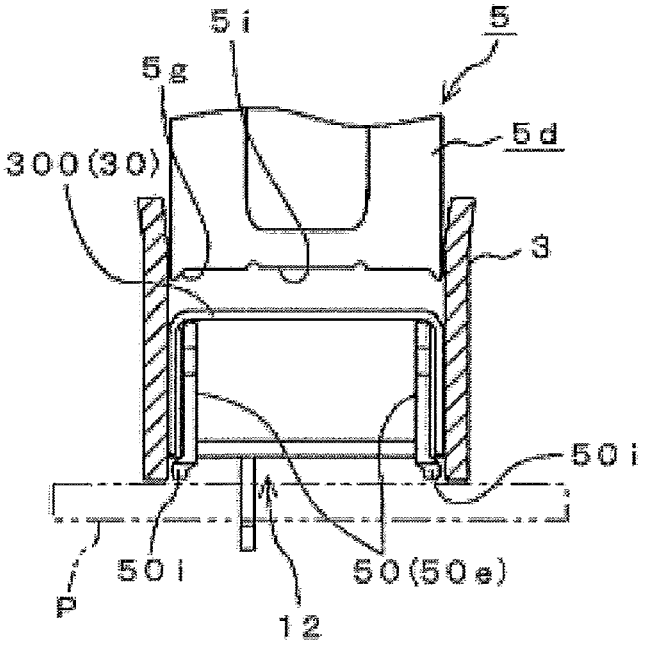
[FIG. 18A] is an elevation for showing an operation example (part one) of the driver 5 and the staple guide 50.
Figure 18B:
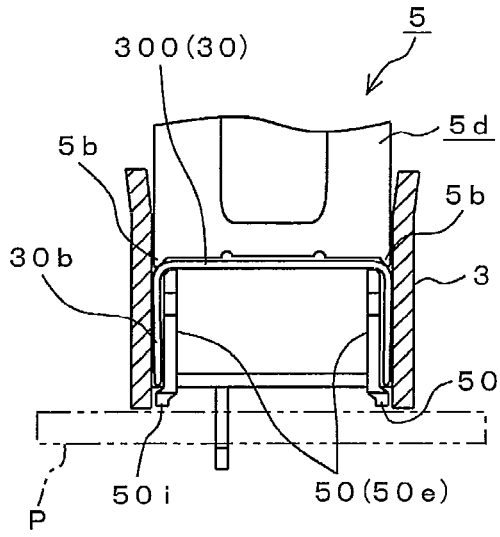
[FIG. 18B] is an elevation for showing the operation example (part two) of the driver 5 and the staple guide 50.

The strip of staples 300 loaded in the magazine 3 is pushed by the pusher 6 shown in FIG. 14A to move to a position where the top staple 30 faces the staple-pushing-out slit 12 of the magazine 3, as shown in FIG. 18A.

In this moment, any clinching force has been not applied to the driver arm 4 shown in FIG. 1, so that the space between the driver arm 4 and the magazine 3 is kept constant by contacting the elastic portion 5*c* of the driver 5 with the staple cover 7 mounted on the magazine 3 as shown in FIG. 1. As a result thereof, the driving portion 5*d* of the driver 5 is on standby with a predetermined space above the top staple 30 of the strip of staples 300 (see FIG. 2) (standby state).

When any clinching force is applied to the driver arm 4, the driver 5 provided on the forward end thereof starts descending. For example, the contacting portions 5*h* of the projections 5*b*, 5*b* of the driving portion 5*d* of the driver 5 shown in FIG. 18B contact the positions of the staple 30 over the legs 30*b*, 30*b*.

Figure 18C:
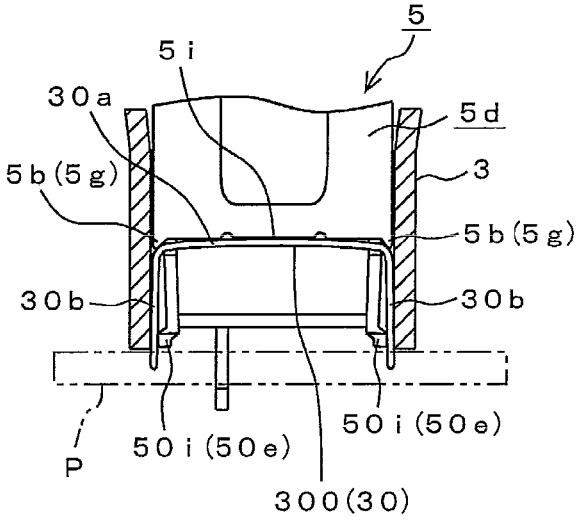
[FIG. 18C] is an elevation for showing the operation example (part three) of the driver 5 and the staple guide 50.

When any clinching force is further applied to the driver arm 4, the driver 5 starts driving the staple 30 out of the magazine 3. For example, the driver 5 drives the top staple 30 and separates it from the strip of staples 300 as shown in FIG. 18C, so that forward ends of the legs 30*b* of the top staple 30 are inserted into the stack of paper P. In this moment, the projections 5*b*, 5*b* of driving portion 5*d* of the driver 5 push the legs 30*b* of the top staple 30 downwards from almost just above. Accordingly, the clinching force is transferred to the legs 30*b*, 30*b* of the top staple 30 on almost straight lines by the projections 5*b*, 5*b*, thereby enabling the clinching force to be concentrated onto the legs 30*b*, 30*b*.

When the top staple 30 descends by pushing-down of the projections 5*b*, 5*b* and the top staple 30 passes through the space L6 (shown in FIG. 11B) between each of the forward ends 50*i*, 50*i* of the elastic portions 50*e*, 50*e* provided on the forward end of the staple guide 50 and each of the inner walls of the magazine 3, the legs 30*b* contact the forward ends 50*i* of the elastic portions 50*e*, 50*e*. In this moment, the forward ends 50*i* of the elastic portions 50*e*, 50*e* are bent inwardly by the legs 30*b* and push the legs 30*b* against the inner walls of the magazine 3, respectively, so that the legs 30*b* can be driven out perpendicular to the stack of paper P. This enables the legs 30*b* to be supported by the staple guide 50, thereby preventing buckling from occurring in the legs 30*b*.

Further, the tapered portions 5*g*, 5*g* of the projections 5*b*, 5*b* and the level portion 5*i* make the crown portion 30*a* of the top staple 30 curved somewhat. This enables any reaction force applied to each of the legs 30*b* of the top staple 30 by the stack of paper P to be canceled by this curved crown portion 30*a*. Accordingly, it is capable of presenting the stapler 100 that can receive any reaction force applied to the staple 30 suitably and has a high-buckling-resistance capacity.

Figure 18D:
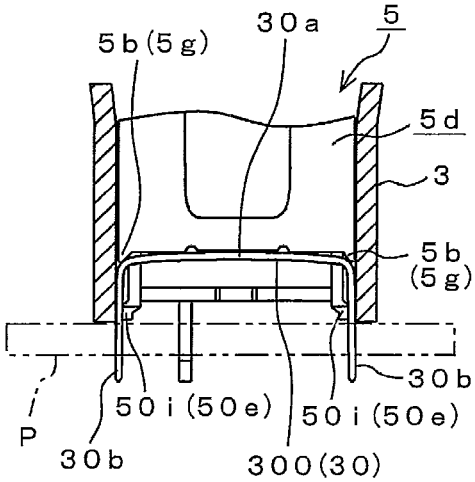
[FIG. 18D] is an elevation for showing the operation example (part four) of the driver 5 and the staple guide 50.

When any clinching force is still further applied to the driver arm 4, the driver 5 drives the top staples 30 pushed out of the magazine 3 to descend it. For example, as shown in FIG. 18D, the driver 5 drives the top staple 30 separated from the strip of staples 300 to descend it, so that the forward ends of the legs 30*b* of the top staple 30 pass through the stack of paper P. In this moment, the projections 5*b*, 5*b* of the driving portion 5*d* of the driver 5 continue to push the legs 30*b*, 30*b* of the top staple 30.

The forward ends 50*i* of the elastic portions 50*e*, 50*e* push the legs 30*b* against the inner walls of the magazine 3 with them being bent inwardly by the legs 30*b* so that the legs 30*b* are driven out perpendicular to the stack of paper P.

Further, the tapered portions 5*g*, 5*g* of the projections 5*b*, 5*b* and the level portion 5*i* make the crown portion 30*a* of the top staple 30 curved somewhat, thereby enabling any reaction force applied to each of the legs 30*b* of the top staple 30 by the stack of paper P to be canceled by the crown portion 30*a*. Thus, the projections 5*b*, 5*b* of the driving portion 5*d* of the driver 5 and the forward ends 50*i*, 50*i* of the elastic portions 50*e*, 50*e* of the staple guide 50 operate.

In the stapler 100 according to the invention, the driver 5 provided on the forward end of the driver arm 4 for driving the staple 30 out of the magazine 3 based on predetermined clinching force has the projections 5*b*, 5*b* that contact the positions of the staple 30, which is supported by the staple guide 50, over the legs 30*b*, 30*b*.

Accordingly, the clinching force is transferred to the legs 30*b*, 30*b* through the projections 5*b*, 5*b* of the driver 5, which can concentrate the clinching force to the legs 30*b*, 30*b*. Moreover, supporting the legs 30*b*, 30*b* by the staple guide 50 allows for preventing buckling from occurring in the legs 30*b*, 30*b*.

Further, the driving portion 5*d* of the driver 5 and the projections 5*b*, 5*b* provided on both sides thereof make the crown portion 30*a* of the top staple 30 curved somewhat, thereby enabling any reaction force applied to each of the legs 30*b* by the stack of paper P to be canceled. Accordingly, it is capable of presenting the stapler 100 that can receive any reaction force applied to the staple 30 suitably and has a high-buckling-resistance capacity.

FIGS. 19A through 19D show an operation example of the driver 5 and the staple guide 50. FIGS. 19A through 19D show the magazine 3 on which the staple guide is mounted and in which the strip of staples 300 (six remaining staples) is loaded, taken on line Y2-Y2 shown in FIG. 11A.

Figure 19A:
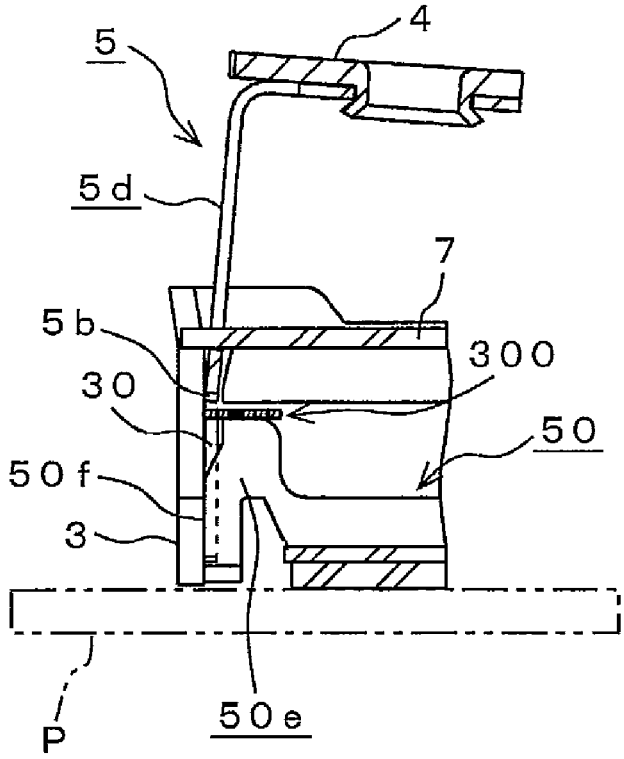
[FIG. 19A] is a side elevation for showing an operation example (part one) of the driver 5 and the staple guide 50.

The driver 5 positioned on the magazine 3 shown in FIG. 19A is on standby as described above. Under this state, the forward end surfaces 50*f*, 50*f* of the elastic portions 50*e*, 50*e* of the staple guide 50 are biased by the spring 3*i* (see FIG. 12A) to contact the front inner wall of the magazine 3.

Figure 19B:
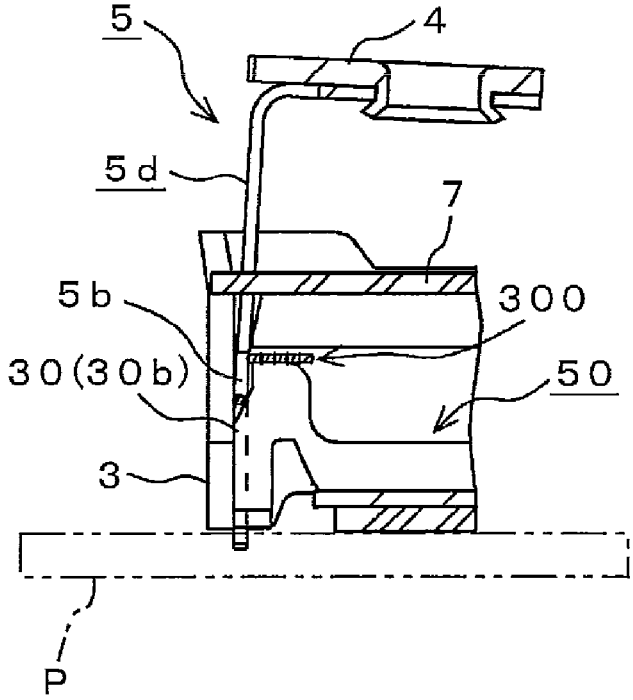
[FIG. 19B] is a side elevation for showing the operation example (part two) of the driver 5 and the staple guide 50.

When any clinching force is applied to the driver arm 4 under this standby state, the driver 5 provided on the forward end thereof starts descending. For example, as shown in FIG. 19B, the projections 5*b*, 5*b* of the driver 5 contact the positions of the top staple 30 over the legs 30*b* to start driving the staple 30 out of the magazine 3. Under this state, the driver 5 shown in FIG. 19B drives the top staple 30 and separates it from the strip of staples 300, so that forward ends of the legs 30*b*, 30*b* of the top staple 30 are inserted into the stack of paper P. In this moment, the forward ends 50*i*, 50*i* of the elastic portions 50*e*, 50*e* provided on the forward end of the staple guide 50 (see FIG. 18C) are bent inwardly by the legs 30*b*, 30*b* and push the legs 30*b* against the side walls of the magazine 3, respectively, so that the legs 30*b*, 30*b* can be driven out perpendicular to the stack of paper P.

Figure 19C:
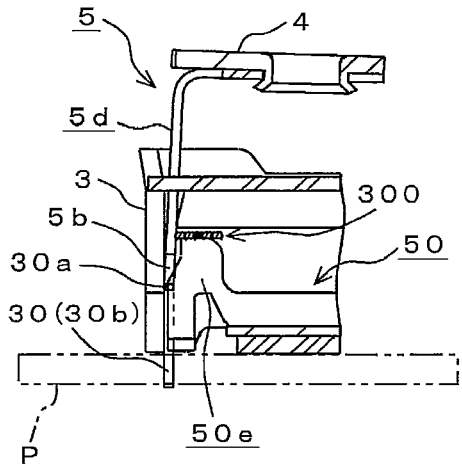
[FIG. 19C] is a side elevation for showing the operation example (part three) of the driver 5 and the staple guide 50.

When any clinching force is further applied to the driver arm 4, the driver 5 shown in FIG. 19C drives the separated staple 30 to descend it, so that the forward ends of the legs 30*b*, 30*b* of the top staple 30 pass through the stack of paper P. In this moment, the crown portion 30*a* of the top staple 30 is slidably connected with the slant portions 50*h*, 50*h* of the elastic portions 50*e*, 50*e* of the staple guide 50 (see FIG. 12B). This slidable connection causes the staple guide 50 biased by the spring 3*i* toward a forward side of the magazine 3 (see FIG. 12A) to be pushed back to move backwards somewhat. It is to be noted that when moving backwards somewhat, the forward ends 50*i*, 50*i* of the elastic portions 50*e*, 50*e* of the staple guide 50 are bent inwardly by the legs 30*b*, 30*b* of the top staple 30 (see FIG. 18C).

Figure 19D:
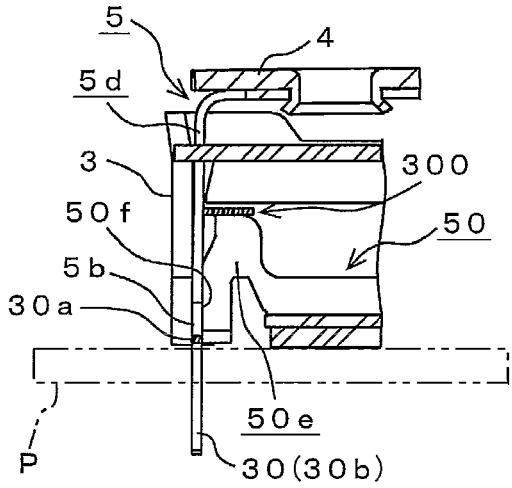
[FIG. 19D] is a side elevation for showing the operation example (part four) of the driver 5 and the staple guide 50.

When any clinching force is still further applied to the driver arm 4, the driver 5, as shown in FIG. 19D, descends the top staples 30. The crown portion 30*a* of the staple 30 almost contacts an upper surface of the stack of paper P, by accompanying the descending of this staple 30. During the course reaching this state, the staple guide 50 in which the crown portion 30*a* is slidably connected with the slant portions 50*h*, 50*h* (see FIG. 12B) is pushed back by the crown portion 30*a* to move rearwards by the thickness L3 of the crown portion 30*a* (see FIG. 3A). In this moment, the staple guide 50 supports the crown portion 30*a* of the top staple 30 by the forward end surfaces 50*f*, 50*f* thereof with the crown portion 30*a* being pushed against the inner wall of the magazine 3. This may prevent buckling from occurring in the crown portion 30*a* thereof. It is to be noted that when the staple guide 50 moves backwards to a position shown in FIG. 19D, the forward ends 50*i*, 50*i* of the elastic portions 50*e*, 50*e* of the staple guide 50 that have been bent inwardly by the legs 30*b*, 30*b* of the staple 30 (see FIG. 18C) return to their original positions (see FIG. 18D).

FIGS. 20A through 20D show an operation example of the driver 5 and the staple-pushing member 40. FIGS. 20A through 20D show the magazine 3 on which the staple-pushing member 40 and the staple guide 50 are mounted and in which the strip of staples 300 (six remaining staples) is loaded, taken on line Y1-Y1 shown in FIG. 9A.

Figure 20A:
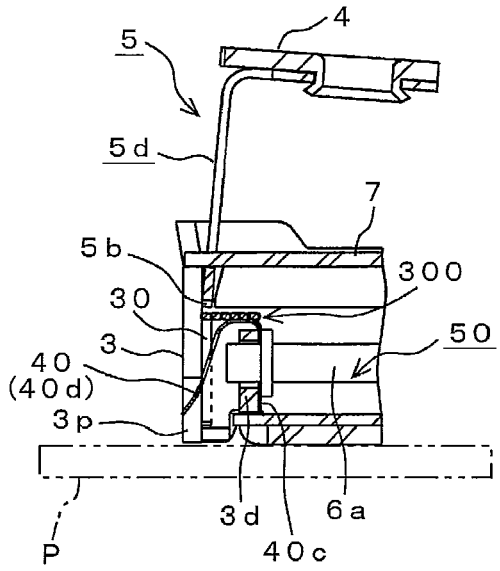
[FIG. 20A] is a side elevation for showing an operation example (part one) of the driver 5 and the staple-pushing member 40.

The driver 5 positioned on the magazine 3 shown in FIG. 20A is on standby as described above. Under this state, the staple-pushing member 40 fixed to the front attaching portion 3*d* of the magazine 3 is positioned so that the forward end portion of the staple-pushing member 40 contacts the front inner wall of the magazine 3 and inserts into the opening 3*p* of the front inner wall of the magazine 3. In this moment, the staple-pushing member 40 does not contact the top staple 30.

Figure 20B:
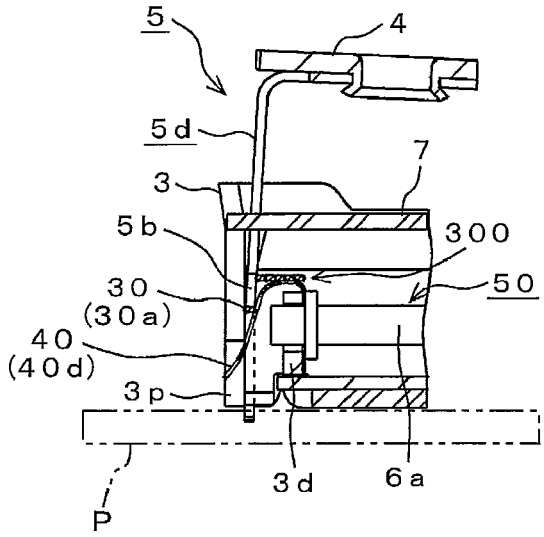
[FIG. 20B] is a side elevation for showing the operation example (part two) of the driver 5 and the staple-pushing member 40.

When any clinching force is applied to the driver arm 4 under this standby state, the driver 5 provided on the forward end of the driver arm 4 starts descending. For example, as shown in FIG. 20B, the driver 5 drives the top staple 30 and separates it from the strip of staples 300, so that forward ends of the legs 30*b* of the staple 30 are inserted into the stack of paper P. In this moment, the elastic pushing portion 40*d* of the staple-pushing member 40 contacts the crown portion 30*a* of the top staple 30.

Figure 20C:
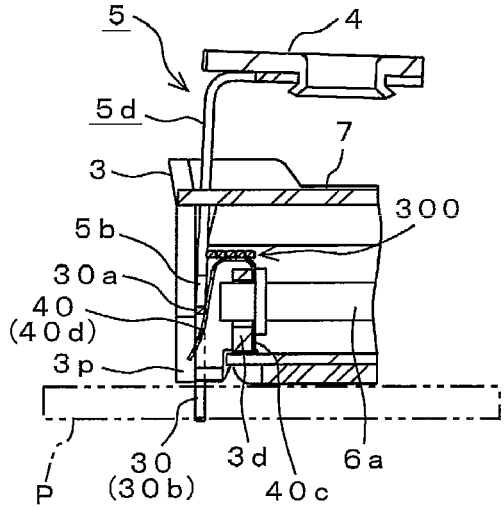
[FIG. 20C] is a side elevation for showing the operation example (part three) of the driver 5 and the staple-pushing member 40.

When any clinching force is further applied to the driver arm 4, the driver 5 shown in FIG. 20C descends the separated top staples 30. The forward ends of the legs 30*b* of the top staple 30 pass through the stack of paper P, accompanying the descending of the top staple 30. When descending the top staple 30, the elastic pushing portion 40*d* of the staple-pushing member 40, which has contacted with the crown portion 30*a* of the staple 30, pushes the crown portion 30*a* against the front inner wall of the magazine 3 by utilizing elastic force generated based on its bending configuration to support the crown portion 30*a*. In this moment, as the elastic pushing portion 40*d* of the staple-pushing member 40 is flexed, a space between the elastic pushing portion 40*d* and the attaching portion 40*c* is made narrower than those shown in FIGS. 20A and 20B.

Figure 20D:
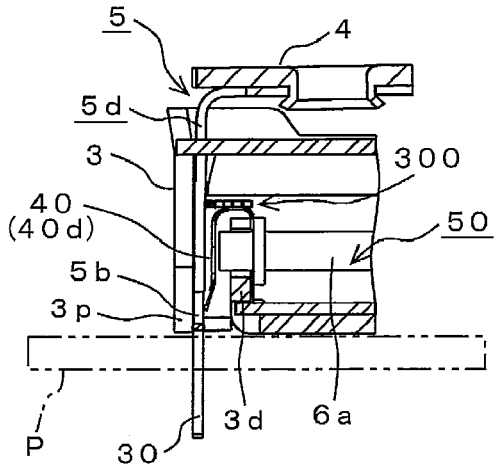
[FIG. 20D] is a side elevation for showing the operation example (part four) of the driver 5 and the staple-pushing member 40.

When any clinching force is still further applied to the driver arm 4, the driver 5, as shown in FIG. 20D, descends the staples 30. The crown portion 30*a* of the staple 30 nearly contacts an upper surface of the stack of paper P, accompanying the descending of this staple 30. During a process leading to this state, the elastic pushing portion 40*d* pushes the crown portion 30*a* against the front inner wall by utilizing its elastic force to continue to support the crown portion 30*a*.

A forward end of the elastic pushing portion 40*d* is formed so as to be curved outwardly somewhat. This is because the crown portion 30*a* is supported as long as possible by pushing the crown portion 30*a* against the front inner wall of the magazine 3 within a course from an initial state (see FIG. 20B) in which the top staple 30 starts descending up to a state in which the crown portion 30*a* nearly contacts the upper surface of the stack of paper P (see FIG. 20D) by finishing the descending of the staple 30. In other words, as shown in FIG. 20B, under the initial state in which the top staple 30 starts descending, the crown portion 30*a* is pushed against the front inner wall of the magazine 3 by a base side of the elastic pushing portion 40*d*. Further, after forward end of the legs 30*b*, 30*b* of the staple 30 pass through the stack of paper P, the crown portion 30*a* is pushed against the front inner wall of the magazine 3 by the forward end of the elastic pushing portion 40*d* formed so as to be curved outwardly somewhat, as shown in FIG. 20C.

The assembly of the staple guide 50, the pusher 6, the driver 5 having the projection 5*b*, 5*b* and the staple-pushing member 40 as described above enables high clinching ability to be obtained with reducing height of the main body of the stapler 100. It is to be noted that if elasticity of the staple-pushing member 40 is too much or too little, the staple-pushing member 40 may be applied by variously adapting it such as adaptation of material and thickness of the staple-pushing member 40. Further, as the staple-pushing member 40 is made of thin plate, plural staple-pushing members 40 may be used by doubling or redoubling the staple-pushing members 40 after adapting them so as to generate any required elasticity.

Figure 21:
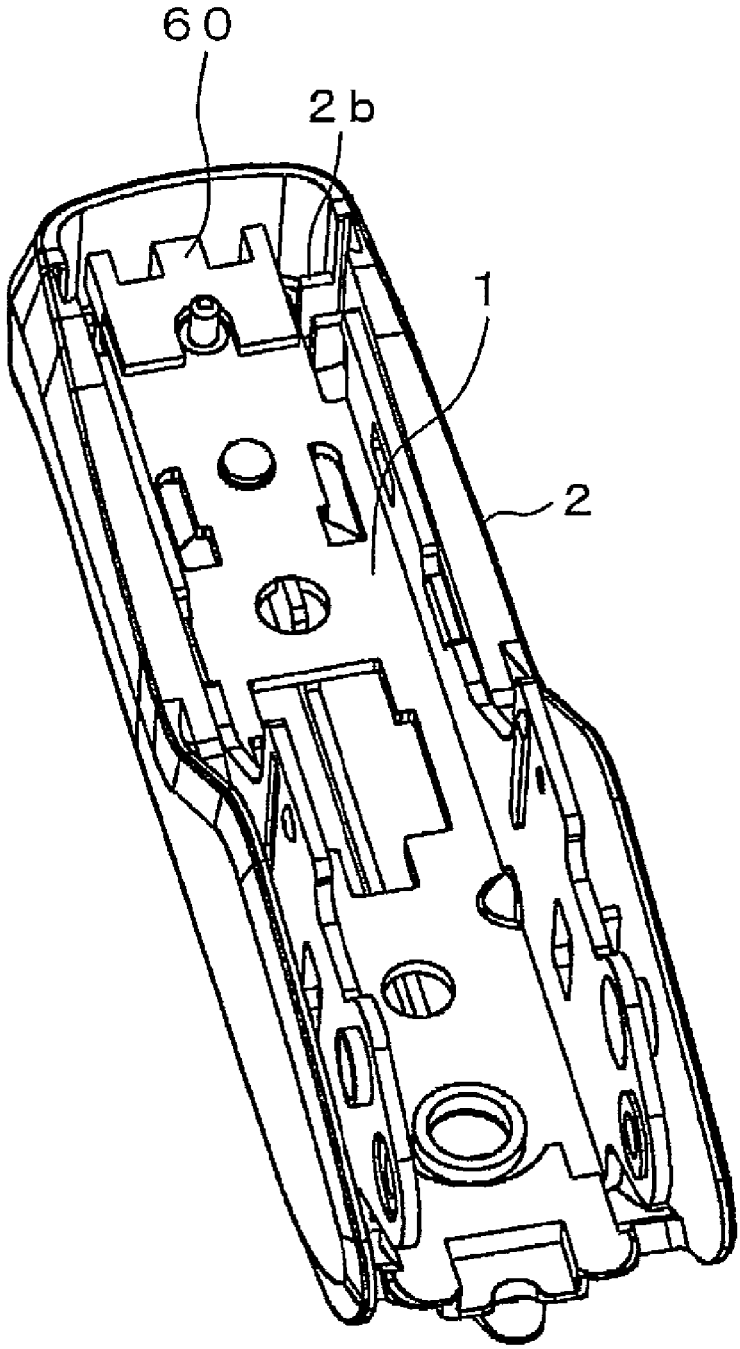
[FIG. 21] is a perspective view of an assembly of a clincher arm 1, a clincher arm cover 2, and a clincher buffer 60 for showing a fitting example of the clincher buffer 60 thereto.

The following will describe a clincher buffer 60. The clincher buffer 60 shown in FIG. 21 constitutes a first buffer member. This clincher buffer 60 is positioned at a position where the clincher guide portion 20 strikes the clincher arm 1 (see FIG. 1), in order to absorb a shock at striking time. In this embodiment, the clincher buffer 60 is attached to a forward end of the clincher arm 1 that the clincher guide portion 20 strikes. It is to be noted that the clincher guide portion 20 shown in FIG. 1 once maintains a space between the magazine 3 and the clincher 1*h* when the staple 30 is driven out of the magazine 3, as described above.

The clincher buffer 60 is made of rubber member, plastic foam member or the like. This plastic foam member is manufactured by foaming plastic member and is formed as various kinds of buffers based on kinds of resin, foaming methods, foaming magnifications and the like. Of course, the clincher buffer 60 is limited to this; it may be made by using another material if it has the same buffer function as those of the rubber member and the plastic foam member.

Figure 22:
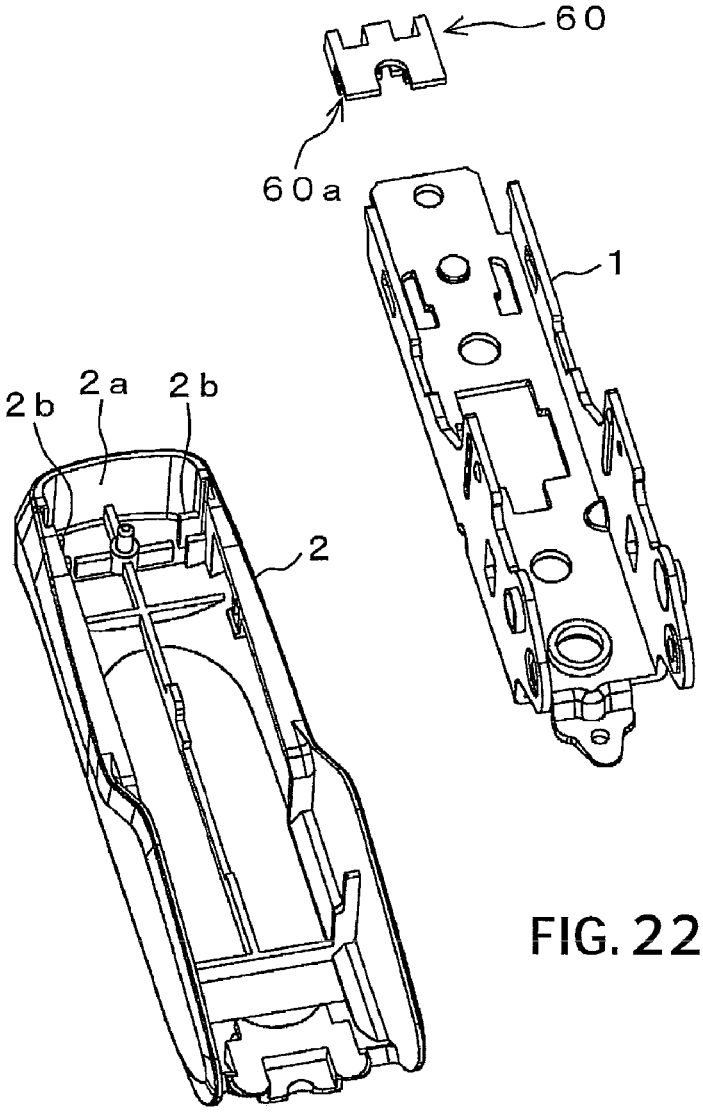
[FIG. 22] is an exploded perspective view of the assembly of the clincher arm 1, the clincher arm cover 2, and the clincher buffer 60 for showing a configuration example of the clincher buffer 60.

FIG. 22 shows a configuration of the clincher buffer 60. The clincher buffer 60 shown in FIG. 22 contains a fitting portion 60*a* having a sectional recess configuration. The forward end of the clincher arm 1 is fitted into this fitting portion 60*a*. The clincher arm 1, the forward end of which is fitted into the fitting portion 60*a*, is then mounted on the clincher arm cover 2. In this moment, a forward end of the clincher buffer 60 contacts a front inner wall 2*a* of the clincher arm cover 2. This front inner wall 2*a* locks the forward end of the clincher buffer 60. Further, into right and left sides of the clincher buffer 60, protrusions 2*b*, 2*b* protruding from both of the inner side walls of the clincher arm cover 2 are respectively inserted. By these protrusions 2*b*, 2*b* protruding from both of the inner side walls thereof, the clincher buffer 60 is prevented from coming off in right and left directions and is fixed.

Figure 23A:
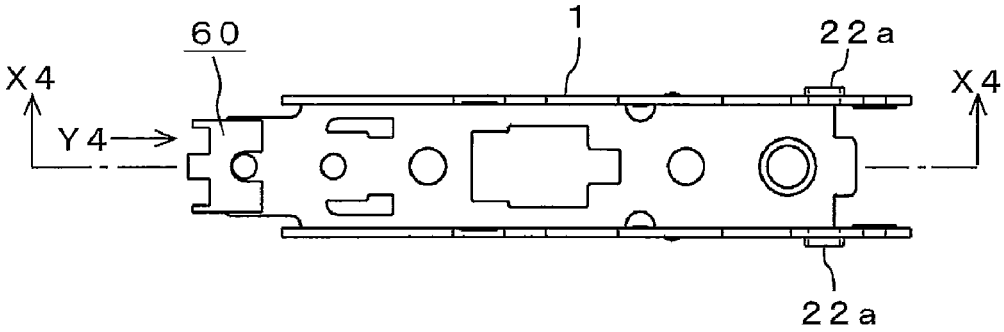
[FIG. 23A] is a top view of the clincher arm 1 for showing an attachment example of the clincher buffer 60 thereto.
Figure 23B:
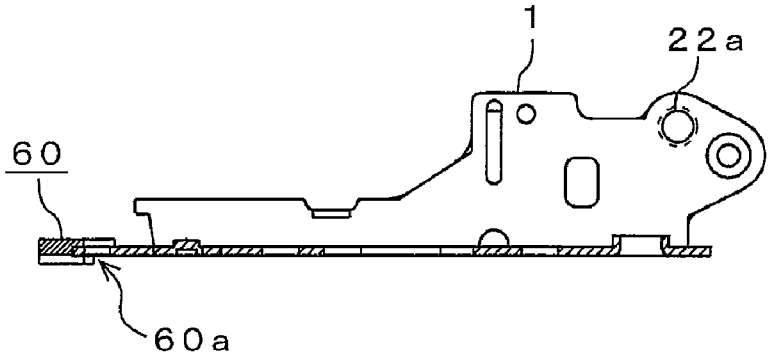
[FIG. 23B] is a sectional view of the clincher arm 1 and the clincher buffer 60, taken on line X4-X4 of FIG. 23A, for showing the attachment example of the clincher buffer 60 thereto.
Figure 23C:
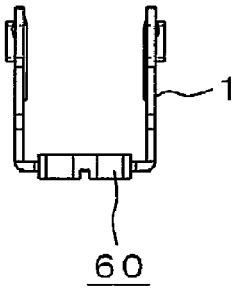
[FIG. 23C] is an elevation of the clincher arm 1 and the clincher buffer 60, shown from a direction along an arrow Y4 of FIG. 23A.

FIG. 23A shows the clincher arm 1 to which the clincher buffer 60 is attached. As shown in FIG. 23B, the forward end of the clincher arm 1 is fitted into the fitting portion 60*a*, which has the sectional recess configuration, of the clincher buffer 60 and attached thereto. As shown in FIG. 23C, the clincher buffer 60 has thickness about three times thickness of the clincher arm 1.

Thus, in the stapler 100 according to the invention, the clincher buffer 60 that absorb a shock is provided and is attached to a position where the clincher 1*h* strikes the clincher arm 1 so that the clincher 1*h* and the clincher arm 1 are assembled through the clincher buffer 60.

Accordingly, the clincher 1*h* strikes the clincher arm 1 through the clincher buffer 60. This enables sound pressure to be reduced when clinching the staple 30 and grating sound to be removed because high-frequency component thereof is reduced.

Figure 24:
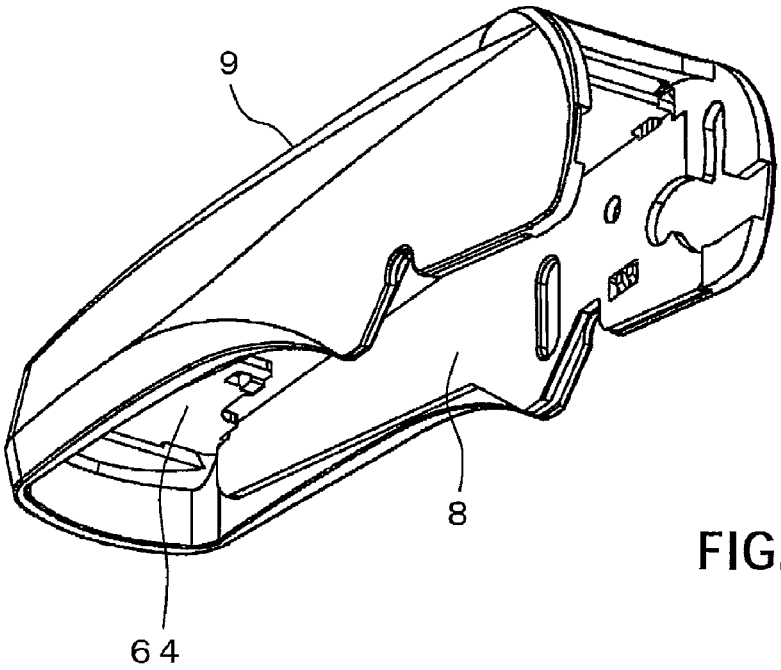
[FIG. 24] is a perspective view of an assembly of a handle 8, a handle cover 9, and a handle buffer 64 for showing a fitting example of the handle buffer 64 thereto.

The following will describe a handle buffer 64. The handle buffer 64 shown in FIG. 24 constitutes a second buffer member. This handle buffer 64 is positioned at a position where the driver arm 4 strikes the handle 8 (see FIG. 1), in order to absorb a shock at striking time. In this embodiment, the handle buffer 64 is attached to a forward end of the handle 8 that the driver arm 4 strikes.

The handle buffer 64 is made of rubber member, plastic foam member or the like. Of course, the handle buffer 64 is limited to this; it may be made by using another material if it has the same buffer function as those of the rubber member and the plastic foam member.

Figure 25:
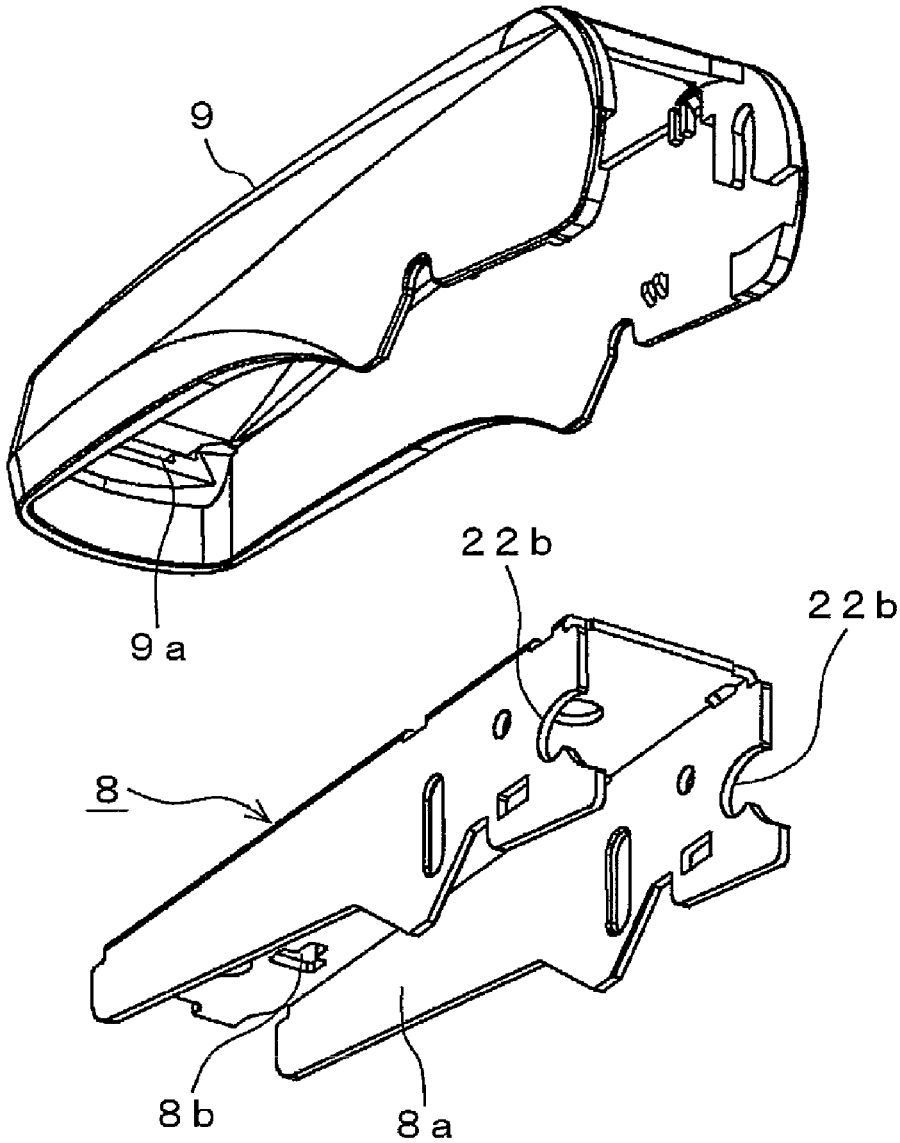
[FIG. 25] is an exploded perspective view of the assembly of the handle 8, the handle cover 9, and the handle buffer 64 for showing a configuration example of the handle buffer 64.
Figure 25:
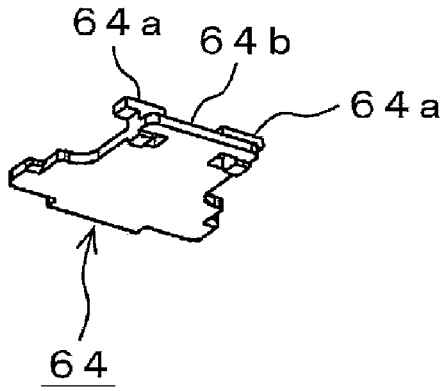

The handle buffer 64 shown in FIG. 25 contains two fitting projections 64*a*, 64*a* each having about T-shape on a back surface 64*b* thereof. These fitting projections 64*a*, 64*a* are fitted into fitting openings 8*b*, 8*b* of the handle 8. The handle 8, to the forward end of which the handle buffer 64 is fitted, is then mounted on the handle cover 9. In this moment, a forward end of the handle buffer 64 is inserted into a groove 9*a* provided on a forward end of the handle cover 9. By this groove 9*a*, the forward end of the handle buffer 64 is locked and is fixed, thereby preventing the handle buffer 64 from falling down.

Figure 26:
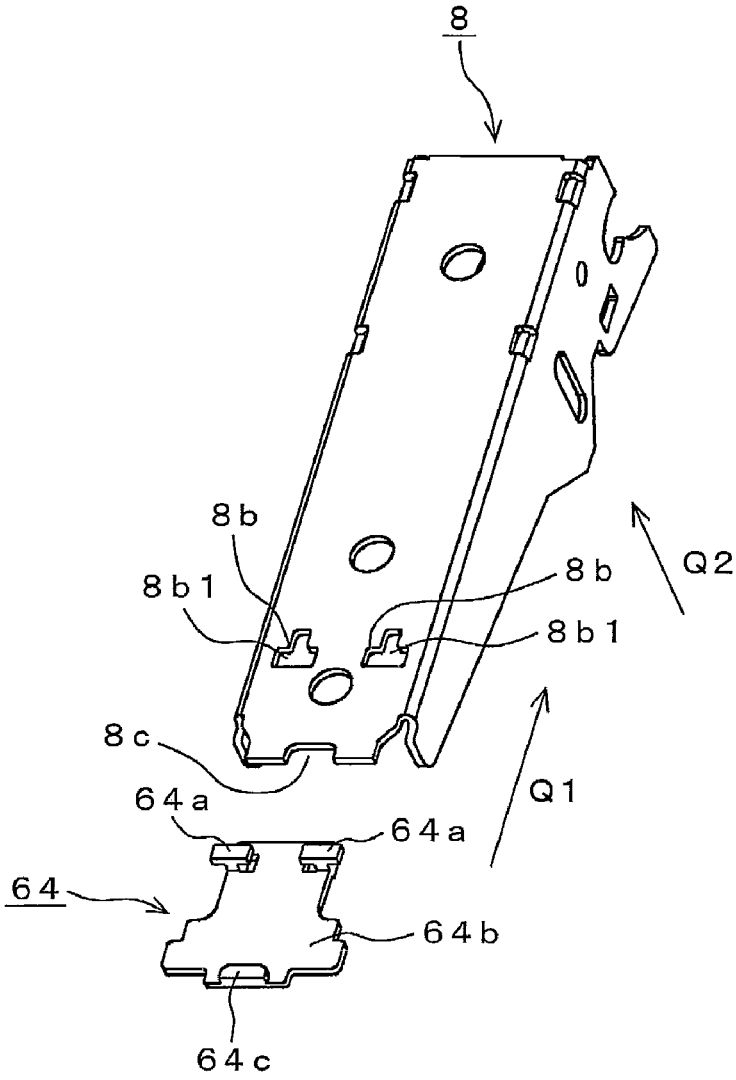
[FIG. 26] is a diagram for showing the configuration example of the handle buffer 64 and illustrating an attachment example of the handle buffer 64 to the handle 8.

As shown in FIG. 26, the respective fitting projections 64*a*, 64*a* each having about T-shape on a rear end portion of the back surface 64*b* of the handle buffer 64 are fitted into the fitting openings 8*b*, 8*b* of the handle 8. In this embodiment, each fitting projection 64*a* having about T-shape is formed so as to be projected from a main body of the handle buffer 64. Each of these fitting projections 64*a*, 64*a* is formed so as to have a base rod and a plate head. A claw portion 64*c* for fastening is provided on a forward end portion of the back surface 64*b* of the handle buffer 64.

Each of the fitting openings 8*b* for fitting this fitting the projection 64*a*, 64*a* is formed in the handle 8 with having T-shape. First, each of the plate heads of the fitting projections 64*a*, 64*a* is inserted into a part 8*b*1 of the fitting opening 8*b* having T-shape. The handle buffer 64 is then slid toward a direction of an arrow Q1 shown in FIG. 26 with the fitting projections 64*a* being inserted into the handle 8 and the claw portion 64*c* of the handle buffer 64 is engaged with an engaging portion 8*c* of the handle 8. This enables the handle buffer 64 to be fastened to the handle 8.

Figure 27A:
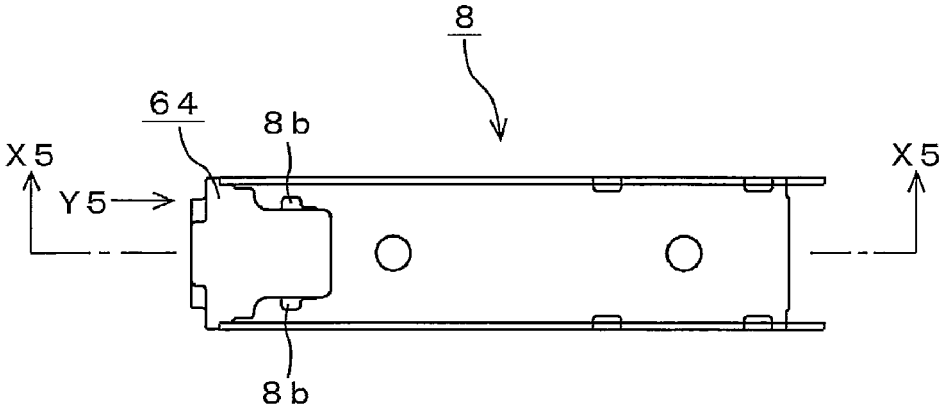
[FIG. 27A] is a bottom view of the handle 8 to which the handle buffer 64 is attached.
Figure 27B:
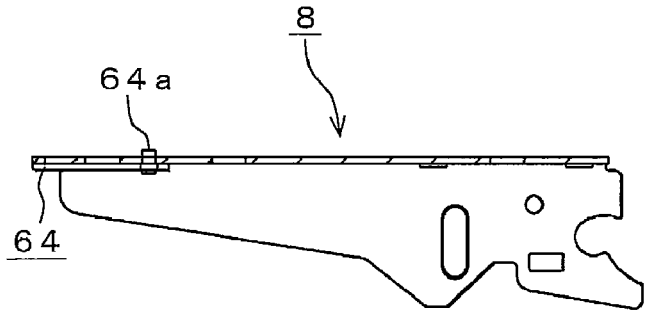
[FIG. 27B] is a sectional view taken on line X5-X5 of FIG. 27A.
Figure 27C:
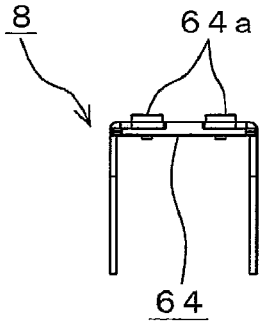
[FIG. 27C] is an elevation shown from a direction along an arrow Y5 of FIG. 27A.

FIG. 27A shows the handle 8 to which the handle buffer 64 is fixed, which is seen from the bottom thereof (along a direction of an arrow Q2 shown in FIG. 26). As shown in FIG. 27B, the heads of the fitting projections 64*a*, 64*a* of the handle buffer 64 are fastened onto an upper surface of the handle 8 and fixed. As shown in FIG. 27C, the heads of the fitting projections 64*a* of the handle buffer 64 are also fastened onto the upper surface of the handle 8 and fixed.

Thus, the driver arm 4 and the handle 8 are struck to each other through the handle buffer 64. This enables sound pressure to be damped when clinching the staple 30 and grating sound to be removed because high-frequency component thereof is reduced.

It is to be noted that although the handle buffer 64 and the clincher buffer 64 have fitted and fixed in the above-mentioned embodiment, they are limited thereto; they may be adhered by adhesive agent and fixed. Further, although the handle buffer 64 has been fixed to the handle 8, it may be fixed to the forward end of the staple cover 7. Additionally, although the clincher buffer 60 has been fixed to the clincher arm 1, it may be fixed to a lower end of the clincher 1*h*.

Figure 28A:
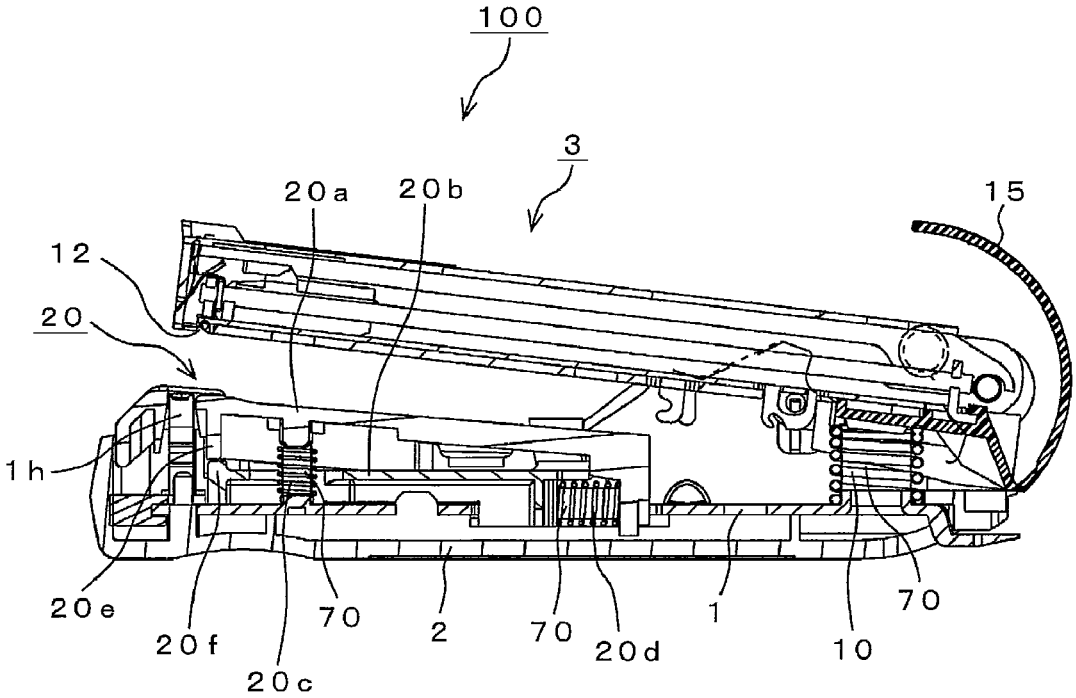
[FIG. 28A] is a sectional view of an important portion of the stapler 100 in which coil springs 10, 20*c*, and 20*d* are installed.

The following will describe the coil springs 10, 20*c*, and 20*d*, which are provided on the stapler 100, each having any damping function of the spring vibration. FIG. 28A shows an example of an important portion of the stapler 100 in which the coil springs 10, 20*c*, and 20*d* are installed.

The coil spring 10 shown in FIG. 28A constitutes a third biasing member and is installed between the rear side of the magazine 3 and the rear side of the clincher arm 1. As described relating to FIG. 1, this coil spring 10 biases the magazine 3 upwards so as to keep a predetermined space between the clincher arm 1 and the magazine 3 in order to intervene the stack of paper between the clincher arm 1 and the magazine 3.

The coil spring 20*c* constitutes a first biasing member and is installed between the clincher guide 20*a* of the clincher guide portion 20 and the clincher arm 1 to bias the clincher guide 20*a* upwards. The coil spring 20*d* constitutes a second biasing member and is installed between a rear end portion of the clincher guide 20*a* and the sliding member 20*b* to bias the sliding member 20*b* toward a forward thereof.

Figure 28B:
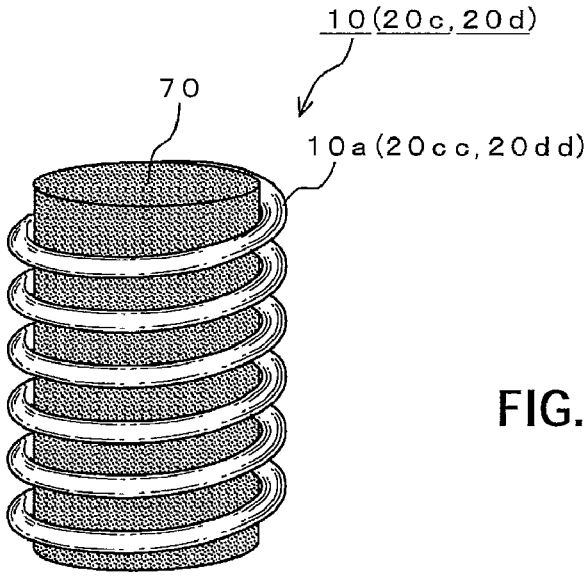
[FIG. 28B] is a perspective view of the coil spring 10 for showing a configuration example thereof.

FIG. 28B shows a configuration example of the coil spring 10 (coil springs 20*c*, 20*d*). The coil spring 10 is formed so as to have a spring main body 10*a* and a vibration-proofing member 70. The spring main body 10*a* is formed so that line member is coiled to have elasticity. The vibration-proofing member 70 is formed so as to have a column shape and a diameter some larger than or equal to an inner diameter of the spring main body 10*a*. Of course, the vibration-proofing member 70 may have any shapes such as a cube and a rectangular parallelepiped that could be included in the spring main body 10*a*, in addition to the column.

The vibration-proofing member 70 is installed inside the spring main body 10*a* and damps vibration of the spring main body 10*a* by contacting the spring main body 10*a*. The vibration-proofing member 70 is made of porous plastic member such as sponge. Of course, the vibration-proofing member 70 is not limited thereto; the vibration-proofing member 70 may be made of any other material if it has the same vibration-proofing function as the sponge and the like. For example, it is conceivable to cover a part of or the whole of spring main body 10*a* with a tube-like member made of rubber material and the like.

The coil spring 20*c* is formed so as to have a spring main body 20*cc* and a vibration-proofing member 70, similarly to the coil spring 10. The vibration-proofing member 70 is installed inside the spring main body 20*cc* and damps vibration of the spring main body 20*cc* by contacting the spring main body 20*cc*.

Further, the coil spring 20*d* is formed so as to have a spring main body 20*dd* and a vibration-proofing member 70, similarly to the coil spring 10. The vibration-proofing member 70 is installed inside the spring main body 20*dd* and damps vibration of the spring main body 20*dd* by contacting the spring main body 20*dd*.

Figure 29:
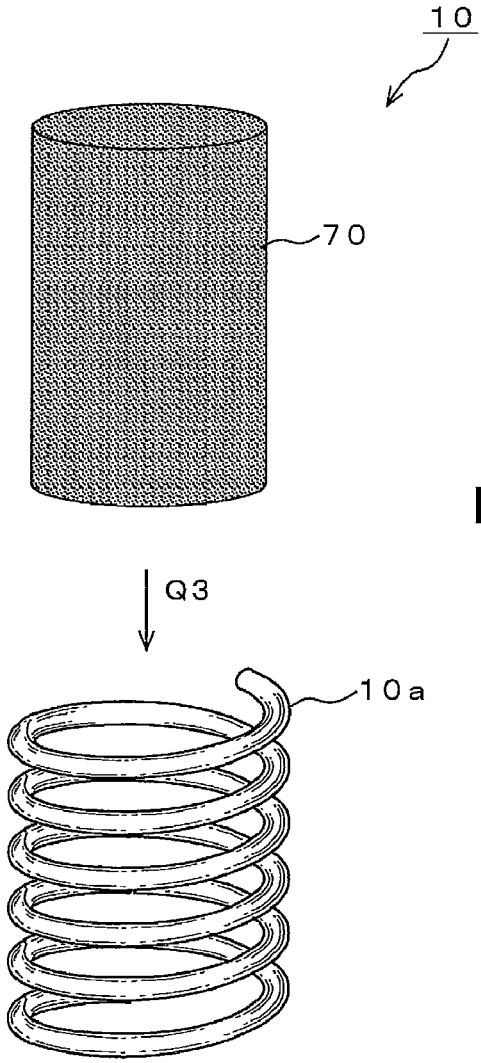
[FIG. 29] is an exploded perspective view of the coil spring 10.

The vibration-proofing member 70 formed so as to have a diameter some larger than an inner diameter of the spring main body 10*a* is forced into an interior of the spring main body 10*a* along a direction of an arrow Q3 shown in FIG. 29. In this moment, by decreasing a width of the vibration-proofing member 70 such as sponge, the vibration-proofing member 70 is forced into the interior of the spring main body 10*a*. This enables the coil spring 10 in which the vibration-proofing member 70 contacts an inner surface of the spring main body 10*a* to be configured. Further, the coil springs 20*c*, 20*d* may be assembled, similarly to a case of the coil spring 10.

Thus, in the stapler 100 according to the invention, the coil spring 20*c* that biases the clincher guide 20 upwards and the coil spring 20*d* that biases the sliding member 20*b*, which enables the clincher guide 20*a* to be kept at its upper position, toward a forward thereof are provided and the vibration-proofing member 70 for damping the vibration is provided in any one of the coil springs 20*c*, 20*d*.

Accordingly, by the vibration-proofing member 70, it is possible to rapidly damp self-vibration of the coil spring 20*c* or 20*d* when it is sprung. This causes any vibration sound by the coil springs based on the vibration of these coil springs to be reduced.

Further, in the stapler 100 according to the invention, the coil spring 10 that biases the magazine 3 upwards is provided and the vibration-proofing member 70 for damping the vibration is provided in the coil spring 10.

Accordingly, by the vibration-proofing member 70, it is possible to rapidly damp self-vibration of the coil spring 10 when it is sprung. This causes any vibration sound by the coil spring 10 based on the vibration of the coil spring to be reduced.

Figure 30:
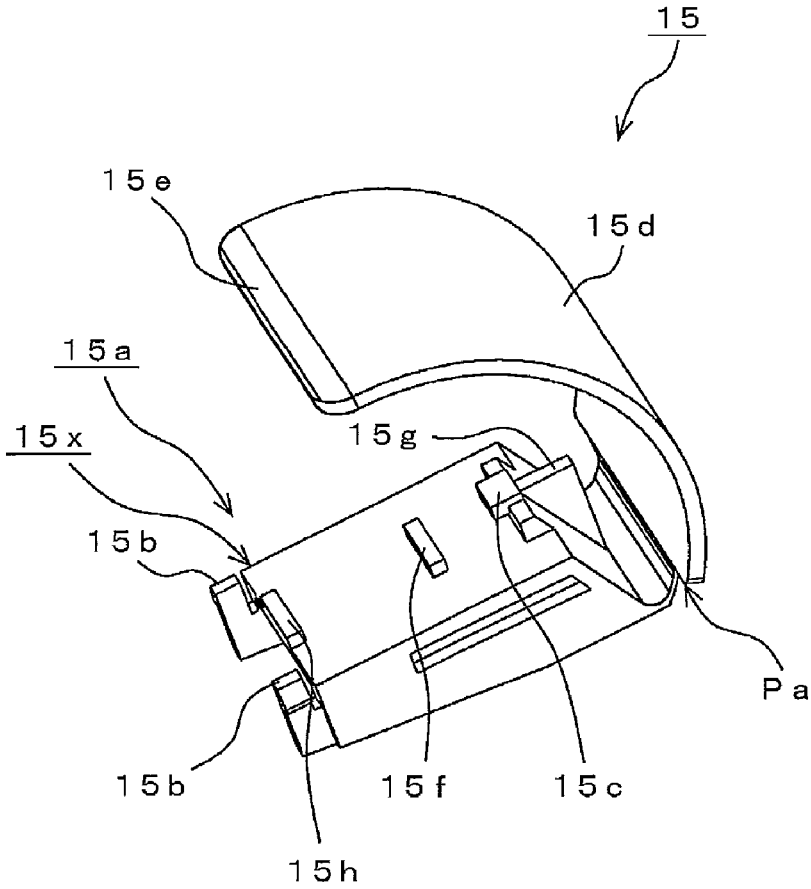
[FIG. 30] is a perspective view of a back cover 15 for showing a configuration example thereof.

The following will describe the back cover 15 installed to a back of the stapler 100. The back cover 15 shown in FIG. 30 constitutes a cover member and contains a base portion 15*a* and a curved cover portion 15*d* having flexibility. The base portion 15*a* of the back cover 15 is attached to a bottom of the magazine 3 shown in FIG. 1. A forward end 15*e* of the curved cover portion 15*d* connected to the base portion 15*a* extends over the magazine 3 to enter into a position between the handle 8 and the handle cover 9, thereby enabling the back cover 15 to be held by the stapler 100 to cover the back of the stapler 100.

The base portion 15*a* contains a base portion main body 15*x*, two projections 15*b*, 15*b* arranged on each side of a forward of the base portion main body 15*x*, and a fastening claw portion 15*c* arranged on a rear middle of the base portion main body 15*x*. The two projections 15*b*, 15*b* are formed to extend toward each side of the forward of the base portion main body 15*x*.

First and second box-like protrusions 15*h*, 15*f* are arranged on a forward end and a middle of an upper surface of the base portion main body 15*x*. These protrusions 15*h*, 15*f* are fitted to grooves, not shown, formed in the bottom of the magazine 3. This may prevent the base portion 15*a* attached to the magazine 3 from wobbling. A reinforcement rib 15*g*, 15*g* is arranged on a rear end of the base portion main body 15*x*.

Further, the curved cover portion 15*d* is connected to the rear end of the base portion 15*a* via a bending fulcrum portion Pa. This curved cover portion 15*d* is made by, for example, injection-molding the synthetic resin using a die and has a stiff property and a property of elastically deformable in a thickness direction thereof.

The curved cover portion 15*d* rotates around the bending fulcrum portion Pa. In this embodiment, the bending fulcrum portion Pa is configured so that its thickness is thinner than that of the curved cover portion 15*d*, thereby forming the self-hinge. When transferring any clinching force to this curved cover portion 15*d*, the curved cover portion 15*d* rotates clockwise or counterclockwise around the bending fulcrum portion Pa.

Figure 31A:
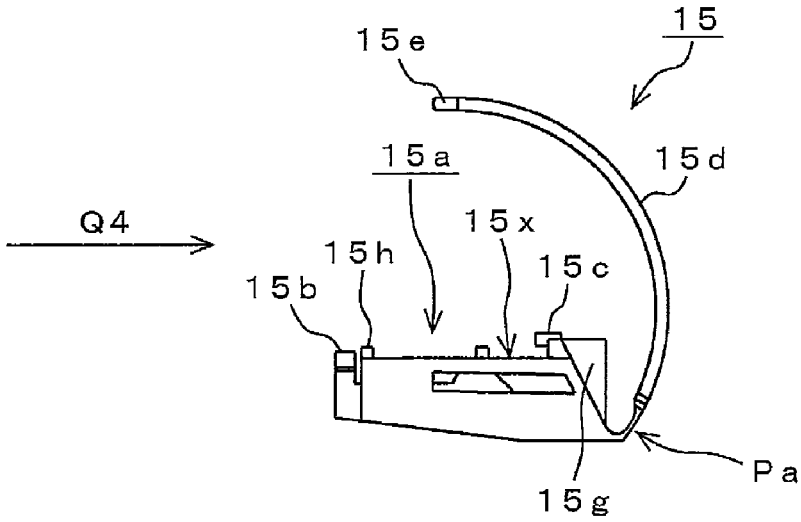
[FIG. 31A] is a side view of the back cover 15.

FIG. 31A shows a side of the back cover 15. The curved cover portion 15*d* of the back cover 15 shown in FIG. 31A is formed so as to be curved so that it stands upwards from the bottom of the base portion 15*a* nearly perpendicularly, then makes about 90 degrees turn, and extends to maintain its horizontal forward end portion. A space between the upper surface of the base portion main body 15*x* and the fastening claw portion 15*c* is almost equal to a thickness of the bottom of the magazine 3. Each of the projections 15*b* has an L-shape and elasticity.

Figure 31B:
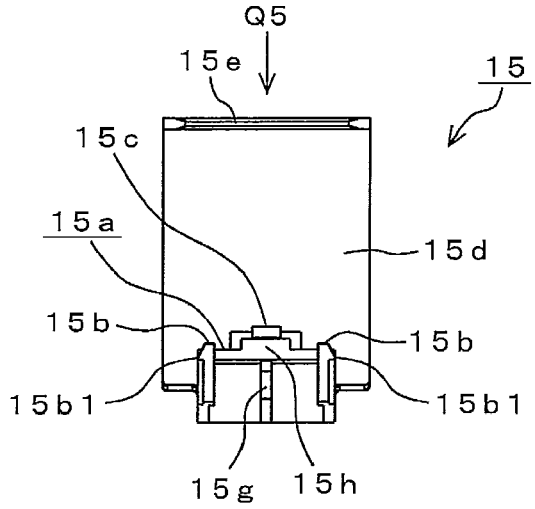
[FIG. 31B] is a front view of the back cover 15.
Figure 31C:
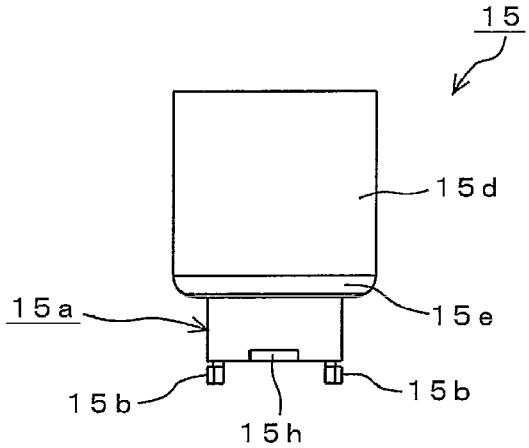
[FIG. 31C] is a top view of the back cover 15.

FIG. 31B shows a front of the back cover 15, which is seen along a direction of an arrow Q4 shown in FIG. 31A. FIG. 31C shows a top of the back cover 15, which is seen along a direction of an arrow Q5 shown in FIG. 31B. A forward end 15*b*1 of each of the projections 15*b*, which are provided on right and left of the base portion 15*a* as shown in FIG. 31B, is formed to extend outwardly.

Figure 32A:
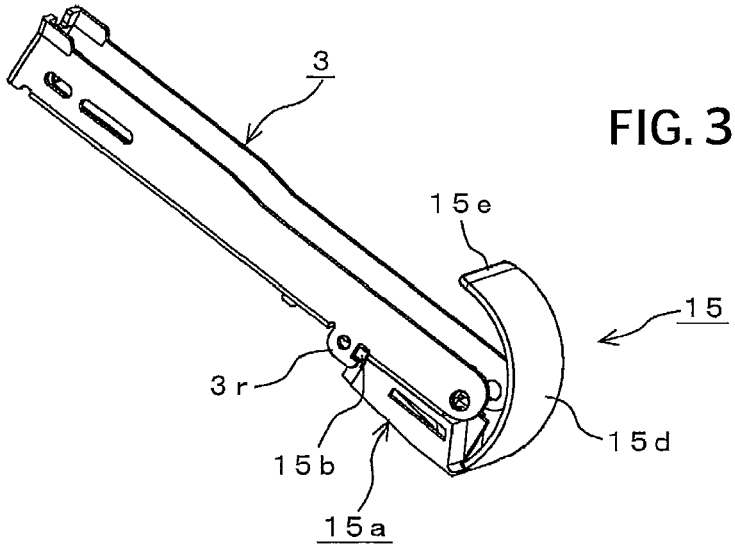
[FIG. 32A] is a perspective view of an assembly of a magazine 3 and the back cover 15, shown from above, for showing a fitting example of the back cover 15 thereto.
Figure 32B:
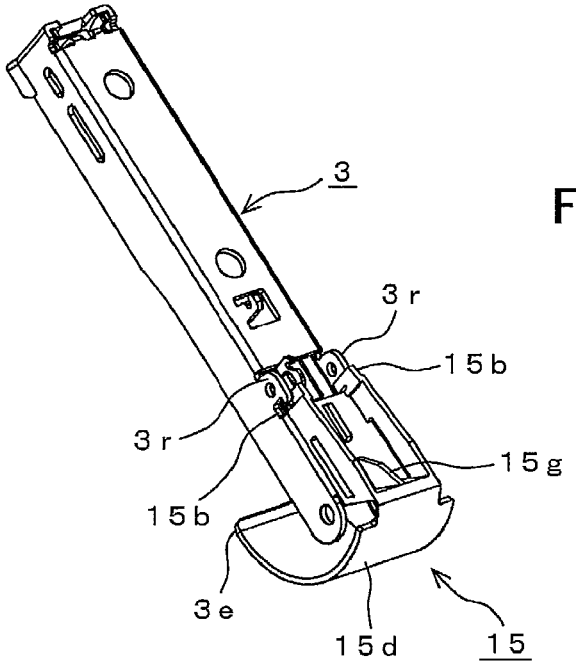
[FIG. 32B] is a perspective view of the assembly of the magazine 3 and the back cover 15, shown from below, for showing the fitting example of the back cover 15 thereto.

FIG. 32A shows the back cover 15 installed to a read end of the magazine 3, which is seen from obliquely above. FIG. 32B shows the back cover 15 installed to the read end of the magazine 3, which is seen from obliquely below. The magazine 3 is provided with attaching hook portions 3*r*, 3*r* extending from the bottom side of the magazine 3 and a fitting portion 3*s* positioned at a position (a rear end) of the magazine 3, which is away from the attaching hook portions 3*r* by a predetermined distance (see FIG. 17).

When the back cover 15 is installed to the magazine 3, the fastening claw portion 15*c* of the back cover 15 (see FIG. 30) is fitted to the fitting portion 3*s* of the magazine 3 and fastened, and the projections 15*b*, 15*b* of the back cover 15 are engaged with the attaching hook portions 3*r*, 3*r* of the magazine 3. This enables the back cover 15 to be tightly installed to the magazine 3 with ease without having any influence upon an interior of the magazine 3.

In this embodiment, the attaching hook portions 3*r* contains recess portions 3*t* (see FIG. 8) for locking. These recess portions 3*t* of the attaching hook portions 3*r* prevent the projections 15*b*, 15*b* from being falling out toward a rear end side of the magazine 3.

Accordingly, it is possible to prevent the back cover 15 from dropping out of the magazine 3 simply when the back cover 15 is assembled to the magazine 3 to form an intermediate assembly during an assembling course of the stapler 100, thereby allowing assembling operation of the stapler 100 to be made easy.

Figure 33A:
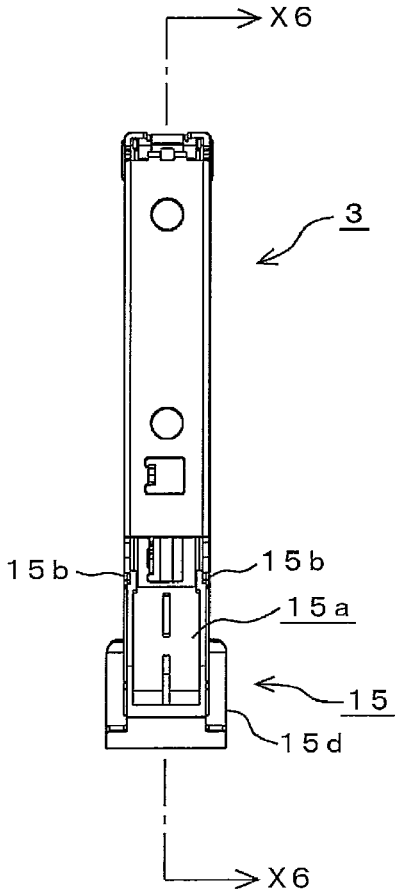
[FIG. 33A] is a bottom view of the assembly of the magazine 3 and the back cover 15 for showing the fitting example of the back cover 15 thereto.
Figure 33B:
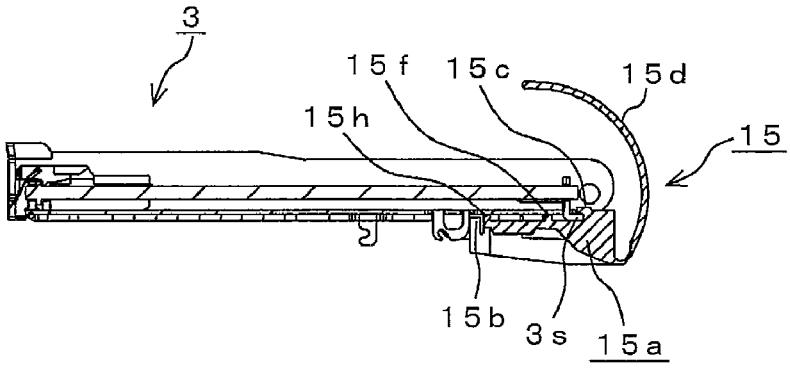
[FIG. 33B] is a sectional view taken on line X6-X6 of FIG. 33A for showing the fitting example of the back cover 15 thereto.

FIG. 33A shows the back cover 15 installed to the read end of the magazine 3, which is seen from a bottom side thereof. The fastening claw portion 15*c* of the back cover 15 shown in FIG. 33B is fitted to the fitting portion 3*s* of the magazine 3 and fastened. Further, the protrusions 15*h*, 15*f* of the back cover 15 are fitted into the grooves, not shown, formed in the bottom of the magazine 3.

Figure 34A:
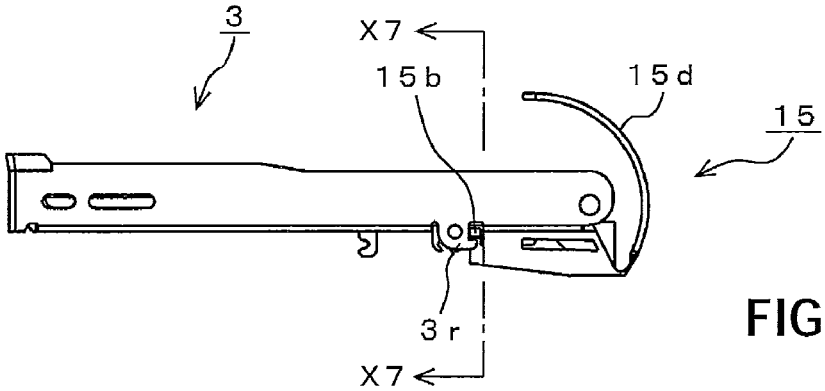
[FIG. 34A] is a side view of the assembly of the magazine 3 and the back cover 15 for showing the fitting example of the back cover 15 thereto.
Figure 34B:
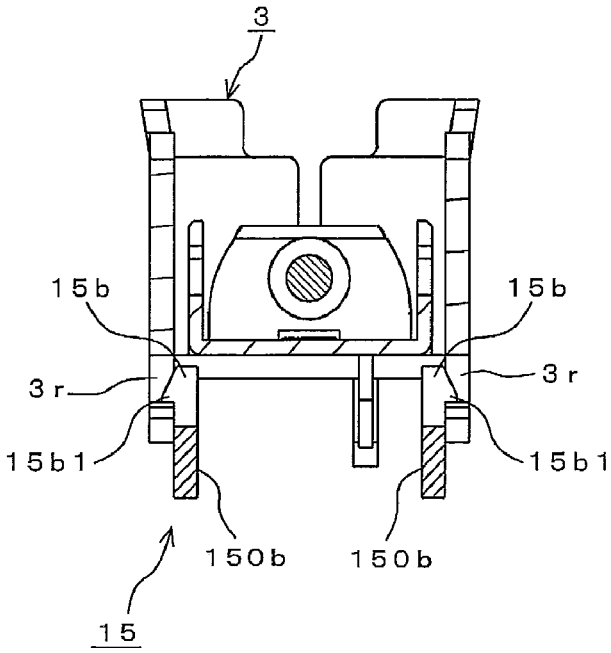
[FIG. 34B] is a sectional view taken on line X7-X7 of FIG. 34A for showing the fitting example of the back cover 15 thereto.

FIG. 34A shows a side of the back cover 15 installed to the read end of the magazine 3. The forward ends 15*b*1 of the projections 15*b*, 15*b* of the back cover 15 are respectively fitted to the attaching hook portions 3*r* of the magazine 3 and fastened, as shown in FIG. 34B. Thus, the back cover 15 is installed to the magazine 3.

Accordingly, in the stapler 100 according to the invention, the fastening claw portion 15*c* of the back cover 15 for covering the back of the stapler 100 is fitted to the fitting portion 3*s* of the magazine 3 and fastened as well as the projections 15*b*, 15*b* of the back cover 15 are engaged with the attaching hook portions 3*r* extending from the bottom side of the magazine 3.

Therefore, it is capable of attach the back cover 15 to the magazine 3 tightly with ease without having any influence upon an interior of the magazine 3.

Figure 35A:
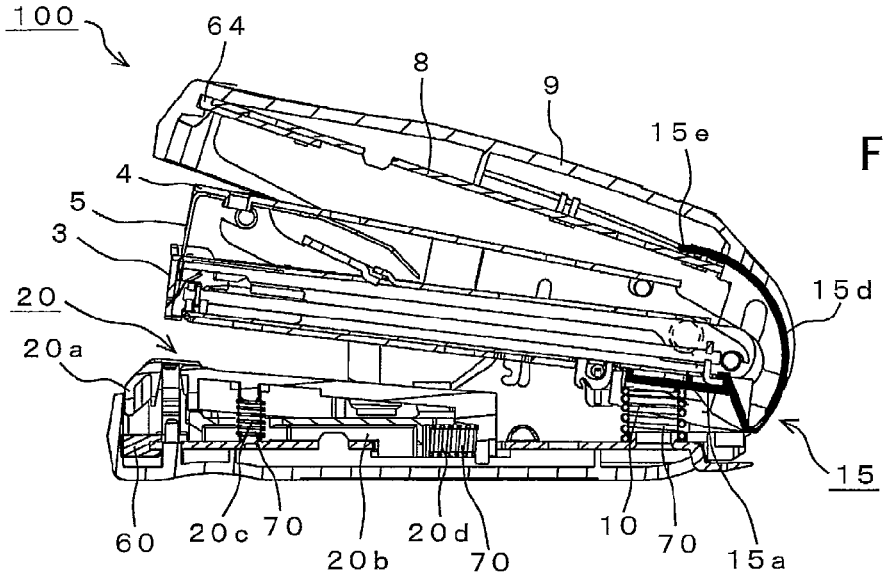
[FIG. 35A] is a sectional view of the stapler 100 for showing a standby state thereof.
Figure 35B:
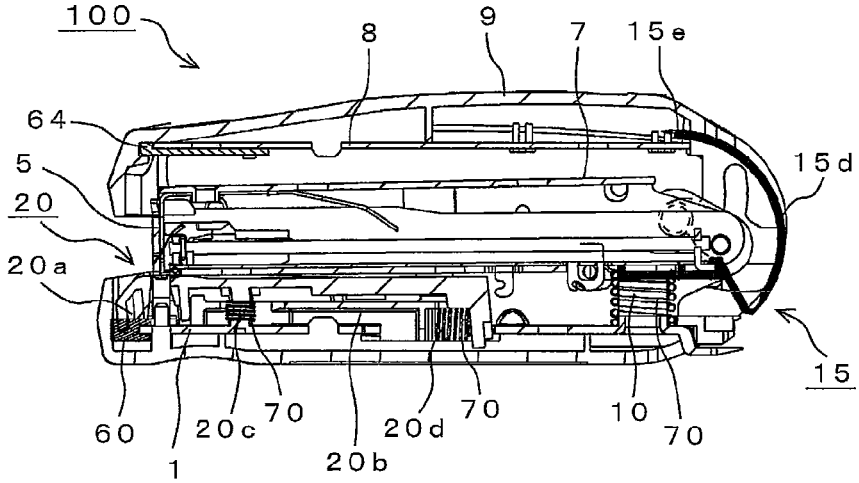
[FIG. 35B] is a sectional view of the stapler 100 for showing a state thereof where it staples a stack of paper.

The following will describe an operation example of the stapler 100 with reference to FIGS. 35A and 35B. Operations and effects of the clincher buffer 60, the handle buffer 64, the vibration-proofing member 70, and the back cover 15 will be describe in this operation example of the stapler 100.

The stapler 100 shown in FIG. 35A is on standby state as described above (equal to the same state as that of the stapler 100 shown in FIG. 1). It is to be noted that the back cover 15 is installed to the bottom of the magazine 3 and the bottom of the back cover 15 is pushed up by the coil spring 10 and fixed.

Under this standby state, the curved cover portion 15*d* of the back cover 15 is curved so that it stands upwards from the bottom of the base portion 15*a* nearly perpendicularly, then makes about 90 degrees turn, and extends to maintain its horizontal forward end portion. In this moment, the forward end 15*e* of the curved cover portion 15*d* is positioned between the handle 8 and the handle cover 9 and the curved cover portion 15*d* covers the back of the stapler 100.

In the stapler 100 shown in FIG. 35B, any clinching force is applied to the handle 8 through the handle cover 9 under the above-mentioned standby state, and the handle 8 rotates so that the driver 5 can drive the staple 30 out of the magazine 3 onto the stack of paper P. The clincher guide 20*a* of the clincher guide portion 20 then descends to staple the stack of paper P.

Under this stapling state, the forward end 15*e* of the curved cover portion 15*d* of the back cover 15 is moved some rearwards from the standby state by accompanying the rotation of the handle 8 and stays in the space between the handle 8 and the handle cover 9. The curved cover portion 15*d* covers the back of the stapler 100.

In this moment, for example, if the forward end 15*e* of the curved cover portion 15*d* is designed to extend between the handle 8 and the driver arm 4, the handle 8 may flatten the curved cover portion 15*d* to make it deformed, which cause any problem to result in waste in the clinching force. In this embodiment, however, the forward end 15*e* of the curved cover portion 15*d* extends between the handle 8 and the handle cover 9, so that the curved cover portion 15*d* can be free from interference with the handle 8, thereby avoiding any waste in the clinching force.

Further, as damping effect, the handle 8 strikes the driver arm 4 through the handle buffer 64 fixed to the forward end of the handle 8, thereby enabling sound pressure to be reduced when clinching the staple 30.

Further, the clincher 1*h* strikes the clincher arm 1 through the clincher buffer 60 fixed to the forward end of the clincher arm 1, thereby enabling sound pressure to be reduced when clinching the staple 30 and high-frequency component thereof to be reduced. This may cause grating sound to be removed.

Further, the vibration-proofing member 70 such as sponge is provided on the coil spring 10 biasing the magazine 3 upwards, the coil spring 20*c* biasing the clincher guide 20*a* upwards, or the coil spring 20*d* biasing the sliding member 20*b* forward so that vibration generated in any of these coil springs can be rapidly damped, thereby enabling vibration sound in the coil springs to be decreased.

Industrial Applicability

The invention is very preferably applicable to a stapler that passes the legs of a staple, which is constituted of a crown portion and the legs extending from both ends of the crown portion, through a stack of paper based on any predetermined clinching force and clinches the legs of staple to staple the stack of paper.

The invention claimed is:

1. A stapler that passes a pair of legs of a staple, which is constituted of a crown portion and the legs extending from both ends of the crown portion, through a stack of paper based on any predetermined clinching force and clinches the legs of staple to staple the stack of paper, characterized in that the stapler comprises:

a magazine that loads a staple therein, the magazine containing a staple-pushing-out slit at an end of the magazine;

a driver arm that contains a driver which comes into contact with the crown portion of the staple positioned on the staple-pushing-out slit at an end thereof, and drives the staple based on the predetermined clinching force; and a staple-pushing member having an elastic pushing portion at its forward end with the elastic pushing portion being curved outwardly so as to extend into an opening in a front inner wall of the magazine, the staple-pushing member being mounted near the staple-pushing-out slit and pushing by the elastic pushing portion the crown portion of the staple driven by the driver arm against the front inner wall of the magazine; and a staple guide member that guides the staple pushed toward the staple-pushing-out slit of the magazine and supports the staple to be driven out of the staple-pushing-out slit of the magazine, the staple guide member being placed inside the magazine, wherein the driver of the driver arm includes a projection that comes into contact with a portion of the staple over the legs thereof, the staple being pushed against the front inner wall of the magazine by the staple-pushing member, the projection of the driver coming into contact with a portion of the staple supported by the staple guide member over any of the legs of the staple, wherein the staple guide member includes an elastic member that supports any one of the legs of the staple driven out of the staple-pushing-out slit of the magazine, wherein the elastic member is positioned so as to face an inner side wall of the magazine with a forward end of the elastic member being spaced from the inner side wall by an amount less than a thickness of any one of the legs of the staple, wherein when any one of the legs of the staple driven out of the staple-pushing-out slit passes through the space between the forward end of the elastic member and the inner side wall of the magazine, the elastic member contacts said any one of the legs of the staple so that said any one of the legs of the staple bends the forward end of the elastic member inwardly and the forward end of the elastic member pushes said any one of the legs against the inner side wall of the magazine; and wherein after said any one of the legs of the staple driven out of the staple-pushing-out slit passes through the space, the forward end of the elastic member returns to an original position thereof.

2. The stapler according to claim 1 characterized in that the magazine includes a front attaching portion provided at a forward inner portion of the magazine and a rear attaching portion provided at a rear inner portion of the magazine; and the stapler further comprises:

a pusher that pushes the staple loaded in the magazine to the staple-pushing-out slit; and an axial guide member that guides the pusher, an end of the axial guide member being attached to the front attaching portion provided at a forward inner portion of the magazine and the other end of the axial guide member being attached to the rear attaching portion provided at a rear inner portion of the magazine;

wherein the staple-pushing member is held by the front attaching portion and the axial guide member within the magazine.

3. The stapler according to claim 2 characterized in that the axial guide member includes a stopping member at a side of an end thereof; and the staple-pushing member is a plate having a bending sectional configuration and strides across the front attaching portion of the magazine with a forward end portion thereof facing a front inner wall of the magazine, a rear end portion of the staple-pushing member being held between the front attaching portion of the magazine and the stopping member of the axial guide member.

4. The stapler according to claim 3 characterized in that the magazine has an opening on a bottom thereof near the front attaching portion thereof; and the rear end portion of the staple-pushing member is inserted into the opening on the bottom of the magazine.

5. The stapler according to claim 3 characterized in that the front attaching portion of the magazine has a first hole to which the end of the axial guide member is inserted; and the staple-pushing member has a second hole, at the rear end portion thereof, to which the end of the axial guide member is inserted, wherein the rear end portion of the staple-pushing member is held between the front attaching portion of the magazine and the stopping member of the axial guide member by inserting the end of the axial guide member into the second hole and then, inserting the end of the axial guide member into the first hole.

6. The stapler according to claim 1 characterized in that the stapler further comprises:

a staple cover that covers the staple in the magazine;

a staple guide member that guides a loaded staple to the staple-pushing-out slit of the magazine, the staple guide member being placed inside the magazine;

a pusher that is slidably engaged with the magazine and pushes the staple loaded in the magazine to the staple-pushing-out slit of the magazine; and a pusher band that pulls the pusher in the opposite direction of the pushing direction of the staple in response to rotation of the staple cover, an end of the pusher band being fixed to the pusher and the other end of the pusher band being fixed to the staple cover, wherein the pusher includes:

a pusher main body that is fixed to the pusher band by inserting the end of the pusher band thereto, the pusher main body being positioned inside the staple guide member; and first and second pusher plates that contact the staple to be guided by the staple guide member, the pusher plates being connected to both sides of the pusher main body with the pusher plates being respectively set across both side edges of the staple guide member.

7. The stapler according to claim 6 characterized in that the pusher main body contains first and second coupling members having different shapes from each other on each side of the pusher main body, wherein the first and second pusher plates respectively contain fitting portions having predetermined shapes to fit the first and second coupling members thereto.

* * * * *